US006533115B2

(12) United States Patent
Saiki et al.

(10) Patent No.: US 6,533,115 B2
(45) Date of Patent: Mar. 18, 2003

(54) PACKAGING BOX FOR SPARK PLUGS

(75) Inventors: Yoshiaki Saiki, Nagoya (JP); Tomoaki Aoki, Nagoya (JP); Hisaki Sanoi, Nagoya (JP); Yoshihiko Kawahara, Kasugai (JP)

(73) Assignees: NGK Spark Plug Co., LTD, Aichi (JP); Kawahara Packaging Corporation, Aichi (JP)

( * ) Notice: Subject to any disclaimer, the term of this patent is extended or adjusted under 35 U.S.C. 154(b) by 0 days.

(21) Appl. No.: 09/947,561

(22) Filed: Sep. 7, 2001

(65) Prior Publication Data

US 2002/0036152 A1 Mar. 28, 2002

(30) Foreign Application Priority Data

Sep. 11, 2000 (JP) ..... 2000-275607

(51) Int. Cl.[7] ..... B65D 85/00
(52) U.S. Cl. ..... 206/327; 206/485
(58) Field of Search ..... 206/211, 327, 206/443, 485, 461, 471, 490

(56) References Cited

U.S. PATENT DOCUMENTS 2,339,555 A * 1/1944 Glass ..... 206/327
2,442,980 A 6/1948 Lewis, Jr.
2,582,476 A * 1/1952 Buttery ..... 206/485
3,115,247 A * 12/1963 Hauser ..... 206/485
3,276,574 A 10/1966 Meyers
5,577,606 A 11/1996 Schwentuchowski et al.
5,829,587 A 11/1998 Saiki et al.

FOREIGN PATENT DOCUMENTS

| | | |
|---|---|---|
| DE | 297 07 921 U | 7/1997 |
| EP | 0 734 959 | 10/1996 |
| EP | 0 895 939 | 2/1999 |
| FR | 45697 | 11/1935 |
| FR | 2 658 787 | 8/1991 |

* cited by examiner

*Primary Examiner*—Luan K. Bui
(74) *Attorney, Agent, or Firm*—Morgan, Lewis & Bockius LLP

(57) ABSTRACT

The packaging box includes an inner box body 20 and an outer box body 10 each made of paper. In the inner box body 20, a protection box portion 21 for protecting the screw portions 3*d* and the outer side electrodes 3*e* of the spark plugs 3 is formed by being bent. Screw portion insertion holes 30 capable of passing the screw portions 3*d* of the spark plugs 3 therethrough and bent tabs 32 being bent at the inside of the protection box portion 21 are provided on the upper surface of the protection box portion 21. The lower surfaces of the large diameter portions 3*c* of the metallic shells of the spark plugs are supported by the upper surface of the protection box portion 21 including the bent edges 31*b* of the bent tabs 32.

17 Claims, 17 Drawing Sheets

PACKAGING BOX FOR SPARK PLUGS

BACKGROUND OF THE INVENTION

The present invention relates to a packaging box for spark plugs which houses and holds a plurality of spark plugs. The present invention, more particularly, relates to a packaging box suitable for spark plugs that is displayed and sold in a suspended state in an automobile parts store etc.

Conventionally, a packaging box for spark plugs that is sold in an automobile parts store is configured in a manner as shown in FIG. 19. For example, the packaging box 100 includes a cover member 101 and a base plate member 103. The cover member 101 is made of plastics formed by die-molding a plurality of plug holding portions 105 so as to match to the shapes of a plurality of spark plugs 3, respectively. The base plate member 103 is made of paper at which a suspending hole 102 is formed. The cover member 101 is adhered to the base plate member 103 in a state that the plurality of spark plugs 3 are held by the plug holding portions 105. Then, the packaging box 100 is suspended on a hook of a sales display rack through the hole 102 when they are sold in an automobile parts store etc.

In recent years, in the industrial society, it has been grappled with the selection of materials which are small in environmental load in view of environmental protection. However, the aforesaid conventional packaging box for spark plugs are not suitable for the environmental protection since the cover member made of plastics is used. Thus, it is proposed to form the cover member by paper like the base plate member. However, even if the cover member is merely formed by paper, when the packaging box suspended on the sales display rack is erroneously fallen, there arises a problem that the spark plugs can not be protected sufficiently and so may be broken and further the breakage of the packaging box can not be prevented.

SUMMARY OF THE INVENTION

Accordingly, the invention has been made in view of the aforesaid problem of the prior art. It is an object of the invention to provide a packaging box for spark plugs which is suitable for such a sales style that the packaging boxes are displayed in suspended states in an automobile parts store etc. Namely, the packaging box according to the present invention is formed in view of the environmental protection and which has sufficient strength upon being fallen.

The above-mentioned object can be achieved by a packaging box for a spark plug, the spark plug including a center electrode, a terminal portion, a metallic shell having a large diameter portion at a center thereof and an engine engagement portion, an outer side electrode having one end coupled to the metallic shell, and an insulation member placed between the center electrode and the metallic shell for holding the center electrode at one end thereof and also holding the terminal portion at the other end thereof, the packaging box according to the present invention comprising:

an inner box body made of paper for holding the spark plug, the inner box body including a protection box portion that is configured by a front side protection wall, a rear side protection wall, a top side protection wall and a bottom side protection wall for protecting the outer side electrode and the engine engagement portion of the spark plug; and an outer box body made of paper and having an inner box body housing space that is formed into a rectangular parallelepiped shape, wherein the top side protection wall has a bendable tab that is bent into an inner side of the protection box portion, the bendable tab in its bent state forms an engine engagement portion insertion part capable of inserting therein the engine engagement portion of the spark plug, and wherein a bent edge of the bendable tab in its bent state supports a lower surface of the large diameter portion when the engine engagement portion of the spark plug is inserted into the engine engagement portion insertion part.

In the packaging box, it is advantageous that the bendable tab is defined by a cut line that comprises:

an arc cut line formed along an outer periphery of the engine engagement portion insertion hole, a split cut line for dividing a surface area corresponding to the engine engagement portion insertion hole into two areas, and an auxiliary cut line extending from the arc cut line toward the bent edge of the top side protection wall.

In the packaging box, it is advantageous that a width of the bottom side protection wall in a front-rear direction of the inner box body is determined in accordance with a width of the inner box body housing space in a front-rear direction of the outer box body.

In the packaging box, it is advantageous that one of the front side protection wall and the rear side protection wall has a projection piece which extended beyond a bending line relative to the bottom side protection wall and extended in flush with the one of the walls.

In the packaging box, it is advantageous to further comprises:

a reinforcement plate made of paper and having an insertion slit formed by cutting an arc area having a diameter smaller than that of the engine engagement portion insertion part, wherein the reinforcement plate has a portion inserted between the large diameter portion of the spark plug and the top side protection wall of the protection box portion.

In the packaging box, it is advantageous that the reinforcement plate comprises:

a horizontal reinforcement part in which the insertion slit is formed; and a vertical reinforcement plate extending downward from one side edge of the horizontal reinforcement plate.

In the packaging box, it is advantageous that a paper fiber direction of the reinforcement plate intersects a paper fiber direction of the inner box body by a predetermined angle.

In the packaging box, it is advantageous that the inner box body further comprises:

a main body wall extending upward from the protection box portion; and a terminal holding portion connected to the main body wall and having a terminal portion insertion hole that is capable of inserting therein and holding the terminal portion of the spark plug.

In the packaging box, it is advantageous that the terminal holding portion comprises:

a slanted holding wall extending in a slanted upward direction from an upper end edge of the main body wall and having a free end edge that engages with a corner portion of the inner box body housing space of the outer box body in a state that the inner box body is housed in the outer box body, and wherein the main body wall is brought in surface-contact with a wall of the outer box body that defines a part of the inner box body housing space.

In the packaging box, it is advantageous that the terminal holding portion comprises:

an auxiliary wall extending in a direction normal to the main body wall from an end edge of the main body wall; and a slanted wall extending in a slanted downward direction from an end edge of the auxiliary wall and having the terminal portion insertion hole, wherein the terminal holding portion is configured in a box shape that is defined by the main body wall, the auxiliary wall, and the slanted wall.

In the packaging box, it is advantageous that the terminal holding portion comprises:

a cut line extending along an outer periphery of the terminal portion insertion hole, and a pressing tab which is bent in insertion direction and made in contact with pressure to the terminal portion of the spark plug when the terminal portion of the spark plug is inserted into the terminal portion insertion hole.

In the packaging box, it is advantageous that the terminal portion of the spark plug has a screw portion, and the packaging box further comprises:

a screw terminal holding plate made of paper and having a terminal holding portion for holding the screw portion.

In the packaging box, it is advantageous that the top side protection wall further comprises:

an insulation member insertion part which is capable of inserting therein the insulation member of the spark plug and disposed in adjacent to the engine engagement portion insertion part, to thereby hold the adjacent two spark plugs so as to be directed to opposite directions to each other.

In the packaging box, it is advantageous that the inner box body is provided with a flap wall which overlaps on a housing surface of the outer box body in a state that the inner box body is housed at the inner box body housing space within the outer box body.

In the packaging box, it is advantageous that the inner box body housing space of the outer box body is constituted by:

upper side inner box protection wall;

lower side inner box protection wall;

right side inner box protection wall;

left side inner box protection wall;

front side inner box protection wall; and rear side inner box protection wall;

wherein the outer box body further comprises:

a main wall overlapping with the upper portion of the rear side inner box protection wall, and suspension holes aligned each other and formed on the main wall and the upper portion of the rear side inner box protection wall respectively in the overlapped state thereof.

Moreover, the above-mentioned object can also be achieved by a packaging box for spark plugs according to the invention that is arranged in a manner that the packaging box for a spark plug including an inner box body made of paper for holding a spark plug having an insulation member which is held by a metallic shell made of metal provided with a large diameter portion at an almost center portion thereof, and an outer box body of a rectangular parallelepiped shape made of paper which has an inner box body housing space, the inner box body is characterized in that the inner box body is bent to form a protection box portion configured by protection walls which protects an outer side electrode forming a discharge gap between a center electrode held at one end side of the insulation member of the spark plug and the outer side electrode and protects an engine engagement portion formed at the outer side electrode side from a large diameter portion of the metallic shell, at the upper side protection wall at which the large diameter portion of the metallic shell of the spark plug engages, an engine engagement portion insertion hole capable of inserting therein the engine engagement portion of the spark plug is formed, and a bent edge of a bent tab which is bent at inner side of the protection box portion by a cut line extending to the front side protection wall and the rear side protection wall continuing to both ends of the upper side protection wall is formed, and when the engine engagement portion of the spark plug is inserted into the engine engagement portion insertion hole, the gent edge supports a lower surface of the large diameter portion of the metallic shell of the spark plug.

Thus, according to the above-mentioned construction, the engine engagement portion and the outer side electrode of the spark plug are protected by the protection box portion. Further, the large diameter portion of the metallic shell of the spark plug is placed on and supported by the surface area of the upper side protection wall including the bent edge of the bent tab. Furthermore, since all of the packaging box is formed by paper, the packaging box is hardly opened when being displayed at a shop for sales and so protected against theft.

Further, a packaging box for spark plugs according to the invention may be arranged in a manner that the cut line is formed by an arc cut line formed along an outer periphery of the engine engagement portion insertion hole, a split cut line for dividing a surface area corresponding to the engine engagement portion insertion hole into two areas, and an auxiliary cut line extending from the arc cut line toward the bent edge of the upper side protection wall. Thus, according to the invention, a pair of the bent tabs are formed by inserting the engine engagement portion of the spark plug into the engine engagement portion insertion hole.

Further, a packaging box for spark plugs according to the invention may be arranged in a manner that the protection wall between the front side protection wall and the rear side protection wall of the protection box portion is set to have a longitudinal width corresponding to a housing width of the outer box body. Thus, according to the invention, the lower side protection wall of the protection box portion is suitably fixedly held by the outer box body, so that the protection box portion does not wobble in the longitudinal direction and further supports the outer box body thereby to reinforce it.

Further, a packaging box for spark plugs according to the invention may be arranged in a manner that a projection piece is provided at one of the bend edges of the lower side protection wall formed so as to continue at a side opposite to the upper side protection wall between the front side protection wall and the rear side protection wall of the protection box portion, and other of the bend edges of the lower side protection wall and the projection piece abut against a housing surface of the outer box body in a state that the inner box body is housed in the inner box body housing space of the outer box body. Thus, according to the invention, the inner box body is housed within the outer box body in a state that other of the bend edges of the lower side protection wall and the projection piece abut against the housing surface of the outer box body, so that the upper side protection wall is held in a horizontal state and the breakage of the inner box body due to shock upon falling can be prevented by the provision of the projection piece. Further, since the lower side protection wall is configured in a braced shape, the lower side protection wall serves to reinforce the intensity.

Further, a packaging box for spark plugs according to the invention may be arranged in a manner that a reinforcement plate made of paper is provided which is opened at one end and having an insertion slit formed by cutting an arc area having a diameter smaller than that of the engine engagement portion insertion hole, and the reinforcement plate is inserted between the large diameter portion of the spark plug and the upper side protection wall of the protection box portion. Thus, according to the invention, the supporting of the spark plug is reinforced by the reinforcement plate.

Further, a packaging box for spark plugs according to the invention may be arranged in a manner that the reinforcement plate is configured by a horizontal reinforcement plate in which the insertion slit is formed and a vertical reinforcement plate extending downward from one side edge of the horizontal reinforcement plate opposing to the opening of the insertion slit. Thus, according to the invention, the supporting of the spark plug is reinforced by the horizontal reinforcement plate and the a vertical reinforcement plate.

Further, a packaging box for spark plugs according to the invention may be arranged in a manner that the reinforcement plate and the inner box body are configured in a manner that paper fiber directions thereof are perpendicular to each other. Thus, according to the invention, since the paper fiber directions of the reinforcement plate and the inner box body are perpendicular to each other, the reinforcement effect can be attained.

Further, a packaging box for spark plugs according to the invention may be arranged in a manner that the inner box body is provided with a main body wall extending upward from the protection box portion and a terminal holding portion continuing from the main body wall, and the terminal holding portion is provided with a terminal portion insertion hole capable of inserting therein and holding a terminal portion protruding from other end side of the insulation member of the spark plug. Thus, according to the invention, the terminal portion of the spark plug is held by the terminal holding portion.

Further, a packaging box for spark plugs according to the invention may be arranged in a manner that the terminal holding portion is configured by a slanted holding wall extending in a slanted upward direction from upper end edge of the main body wall, and the main body wall overlaps on a housing space of the outer box body and a free end edge of the slanted holding wall engages with a housing corner portion of the outer box body in a state that the inner box body is housed in the outer box body. Thus, according to the invention, the free end edge of the slanted holding wall engages with the housing corner portion in a braced shape manner in a state that the inner box body is housed in the outer box body.

Further, a packaging box for spark plugs according to the invention may be arranged in a manner that the terminal holding portion is configured in a box shape by being bent so as to be formed by an auxiliary wall extending vertically with respect to the main body wall from an end edge of the main body wall and a slanted wall which extends in a slanted downward direction from an end edge of the auxiliary wall and provided with the terminal portion insertion hole. Thus, according to the invention, the terminal portion of the spark plug is held by the box-shaped terminal holding portion.

Further, a packaging box for spark plugs according to the invention may be arranged in a manner that the terminal holding portion is provided with a cut line along an outer periphery of the terminal portion insertion hole, and the terminal holding portion is further provided with a pressing tab which is bent in insertion direction and made in contact with pressure to a terminal portion of the spark plug when the terminal portion of the spark plug is inserted into the terminal portion insertion hole. Thus, according to the invention, the terminal portion of the spark plug is supported with pressure by the pressing tab.

Further, a packaging box for spark plugs according to the invention may be arranged in a manner that a screw terminal holding plate made of paper is provided in which a screw terminal holding potion for holding a screw terminal configured by a screw of the spark plug is formed. Thus, according to the invention, the spark plug can be held even by the screw terminal. In the invention, when the screw terminal holding plate is disposed between the screw terminal of the spark plug and the terminal portion holding portion, the workability of fabricating the packaging boxes can be improved. Further, when the screw terminal holding plate is set so as to have a width almost same as the terminal holding portion and not to abut against the outer box body, the outer box body can be prevented from being damaged upon falling.

Further, a packaging box for spark plugs according to the invention may be arranged in a manner that the upper side protection wall of the protection box portion is provided in adjacent to the engine engagement portion insertion hole with an insulation member insertion hole in which the insulation member of the spark plug is inserted, the inner box body is formed by a pair of the protection box portions, and the engine engagement portion of the one spark plug is inserted into the engine engagement portion insertion hole of one of the pair of the protection box portions and the insulation member of the one spark plug is inserted into the insulation member insertion hole of other of the pair of the protection box portions to thereby hold the adjacent two spark plugs so as to be directed to opposite direction to each other within the inner box body. Thus, according to the invention, the adjacent two spark plugs are held so as to be directed to opposite direction to each other by the pair of protection box portions, so that the housing volume can be reduced.

Further, a packaging box for spark plugs according to the invention may be arranged in a manner that the inner box body is provided with a flap wall which overlaps on a housing surface of the outer box body in a state that the inner box body is housed at the inner box body housing space within the outer box body. Thus, according to the invention, the spark plug can be protected by the slap wall and the outer box body is prevented from being damaged by the abutment of the spark plug. In the invention, when the inner box body is formed by cardboard material, the thickness of the cardboard material and the structural feature of the cardboard material of being likely smashed in the thickness direction serve to absorb the impact applied to the packaging box, the engine engagement portion and the gap can be protected effectively. Further, in the invention, although the packaging box likely wobbles and the tolerance of size is large since it is made of paper, the inner box body and the outer box body can be fixed surely when the inner box body and the outer box body are adhered to each other.

Further, a packaging box for spark plugs according to the invention may be arranged in a manner that the outer box body is configured by upper, lower, left, right, front and rear side inner box protection walls forming the inner box body housing space and a main wall which continues to a rear side edge of the upper side inner box protection wall and extends upward, an elevational width of the rear side inner box protection wall is set in a manner that a upper portion of the rear side inner box protection wall and the main wall overlap to each other, and the main wall and the rear side inner box protection wall are respectively provided with suspension holes which continue in a state that the main wall and the rear side inner box protection wall are overlapped. Thus, according to the invention, the inner box body is protected by the outer box body and the packaging box is suspended by using the suspension holes. Further, since the periphery of the suspension hole is configured as a dual structure of the rear side inner box protection wall and the main wall, the intensity of the packaging box is enhanced. In the invention, when the outer box body is configured by the paper member one end of which is subjected to the coating processing, the outer box body has good appearance and the intensity of the adhered surfaces is high. Further, in the invention, a view window capable of recognizing the presence of the spark plugs may be formed at the inner box protection wall in a state that the inner box body holding the spark plug is housed within the inner box body housing space.

DETAILED DESCRIPTION OF THE PREFERRED EMBODIMENTS

Hereinafter, the first to fourth embodiments of a packaging box for spark plugs according to the invention will be explained with reference to the accompanying drawings. Among the respective figures, the elevational (upper and lower) direction a, the longitudinal (front and rear) direction b, and the transverse (left and right) direction c correspond from one another.

1. First Embodiment (1) Outer box body 10

Figure 1:
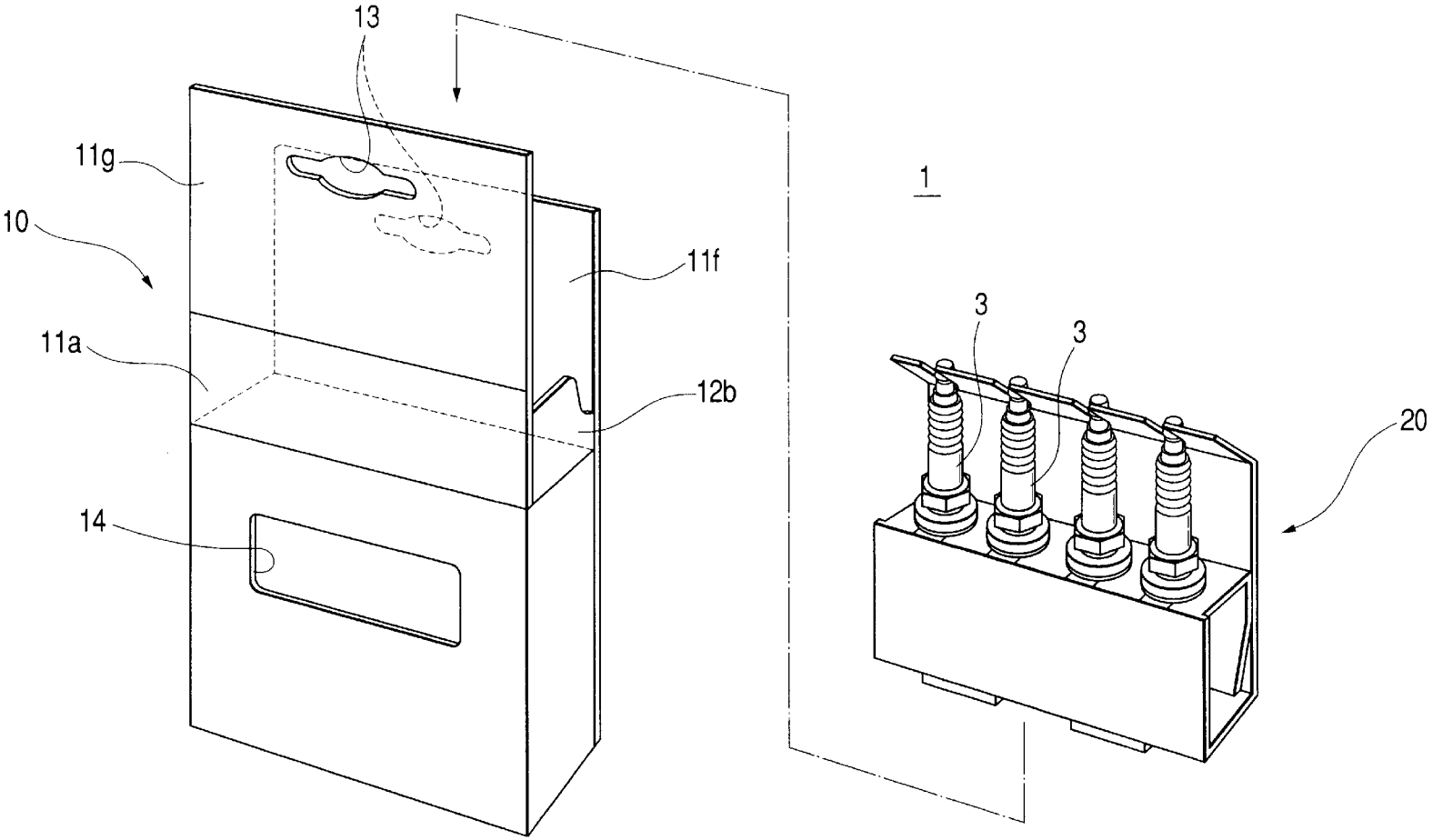
FIG. 1 is a perspective view for explaining the assembling of an inner box body with respect to an outer box body.
Figure 2:
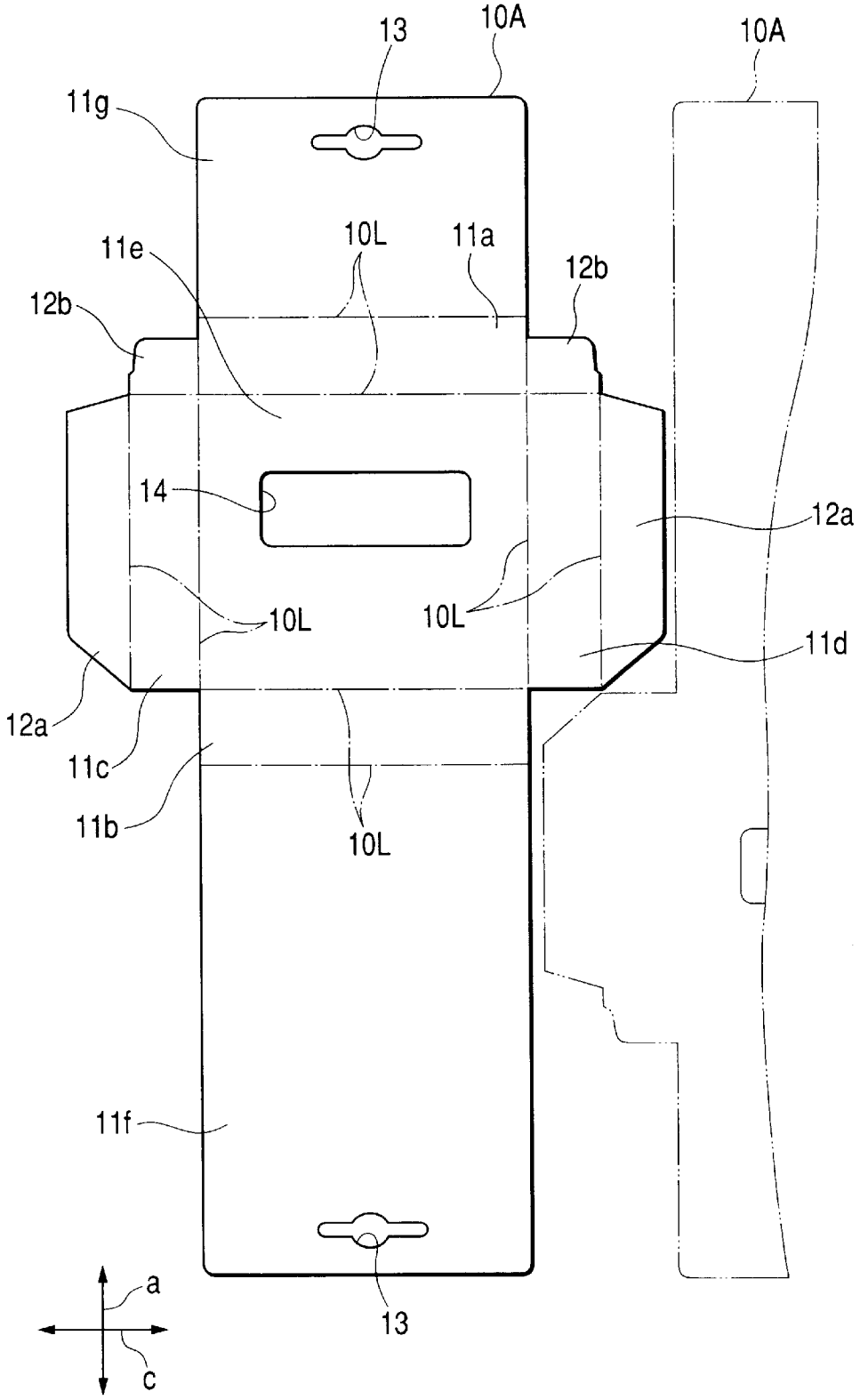
FIG. 2 is an expanded view of the outer box body.

As shown in FIG. 1, the packing box 1 for housing and holding a plurality of (for example, four) spark plugs 3 is configured by an inner box body 20 and an outer box body 10. Explanation will be made as to the outer box body 10, at first. As shown in FIG. 2, a plurality of cutting sheets 10A for outer boxes is cut out from a sheet of raw material paper (for example, a cardboard). Each of the cutting sheet 10A is provided with upper and lower side, left and right side, front and rear side inner box protection walls 11*a*, 11*b*, 11*c*, 11*d*, 11*e*, 11*f* which are suitably set to predetermined values in their shapes and sizes so as to house the inner box body 20 therein and a main wall 11*g*. The left and right side inner box protection walls 11*c* and 11*d* are continuously provided with overlap-width and folding flap walls 12*a* and 12*b* with respect to the upper side and rear side inner box protection walls 11*a* and 11*f*, respectively. Since a flap wall is not provided with respect to the lower side inner box protection wall as a folding flap wall, the workability of fabricating the outer box body can be improved. Further, the respective flap walls 12*a*, 12*b* are disposed on the one side along the elevational direction with respect to a folding line which is an almost center line of the entire length along the elevational direction of the cutting sheet 10A. Further, since the adjacent cutting sheets 10A for the outer box are disposed upside down and the transversal phases of the respective flap walls 12*a*, 12*b* are overlapped in a single row material paper, the paper can be cut with the minimum amount of material.

Figure 7:
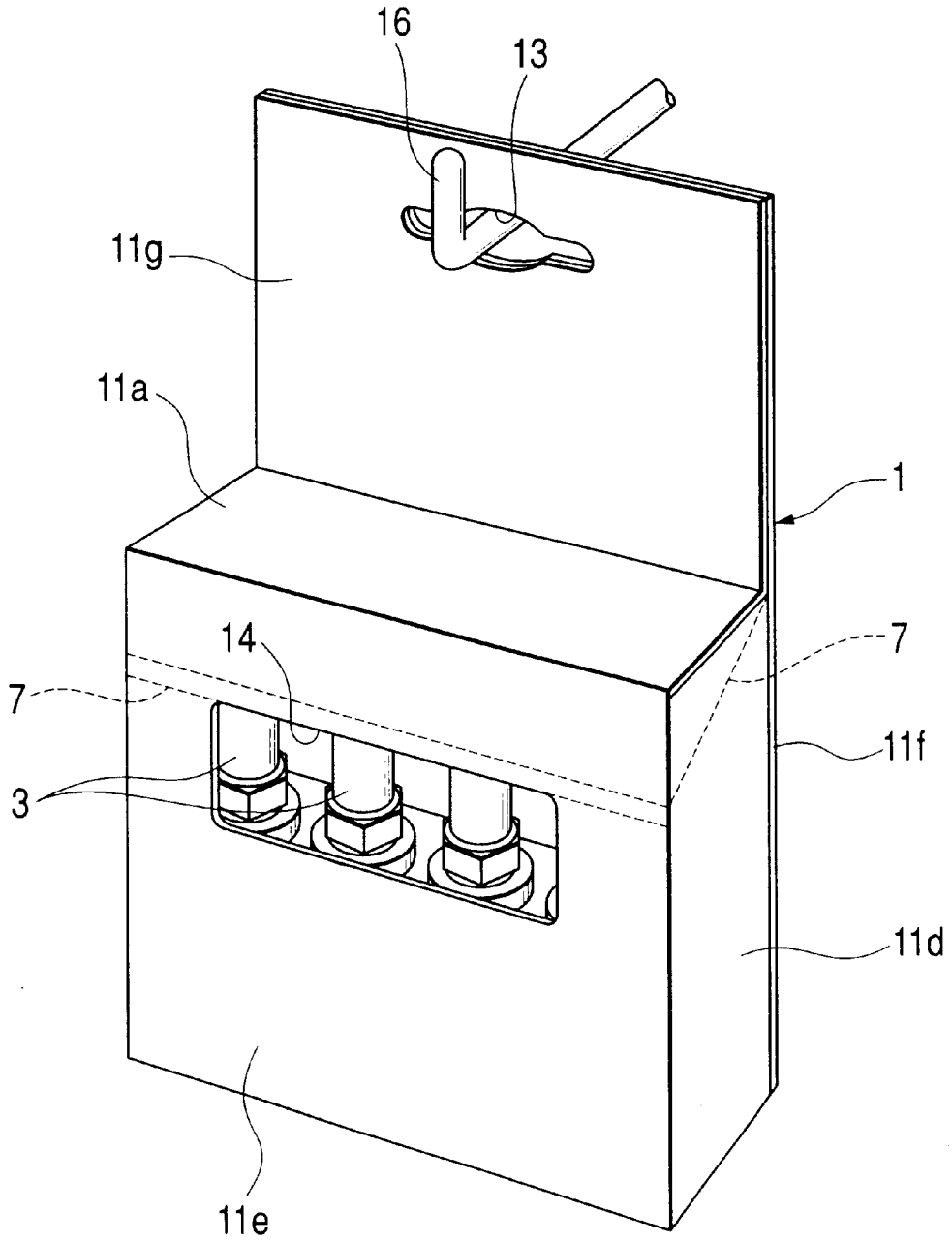
FIG. 7 is a perspective view of the packaging box.

The cutting sheet 10A for the outer box is formed by a cutting process. In the cutting process, a plurality of folding lines 10L (shown by a dot-and-dashed line in the figure) are formed, and suspending holes 13 are also formed at the upper and main wall 11*g* of the rear side inner box protection wall 11*f*. Further, in the cutting process, a view window 14 through which the spark plugs are visible is formed at the front side inner box protection wall 11*e*. The outer box body 10 which is opened at the upper portion thereof is assembled by bending the cut sheet along the folding lines 10L, then pasting adhesive agent etc. on the flap walls 12*a* and adhering the respective flap walls 12*a* to the corresponding portions (see FIG. 1). Further, as shown in FIG. 7, the outer box body 10 is arranged to protect the inner box body by the upper and lower side, left and right side, front and rear side inner box protection walls 11*a* to 11*f* in a state of housing the inner box body 20 described later therein. Furthermore, the width size along the elevational direction of the rear side inner box protection wall 11*f* is set to be longer than those of the front side, right and left side inner box protection walls 11*e*, 11*c*, 11*d*. In the assembled state, the upper portion of the rear side inner box protection wall 11*f* overlaps with the entire area of the main wall 11*g* and the respective suspending holes 13 of both the inner box protection walls 11*f*, 11*g* are made continuous. The outer box body 10 is arranged in a manner that its paper fiber direction is set in the transverse direction. Thus, since the left and right side inner box protection walls 11*c*, 11*d* and the flap wall 12*a* are bent so as to cross in the paper fiber direction, the bent shapes thereof are stable and the inner box body 20 can be inserted easily within the outer box body 10. Further, when the view window 14 is formed at the outer box body, there scarcely occurs an expanded portion at the periphery of the view window 14.

(2) Inner Box Body 20

Figure 3:
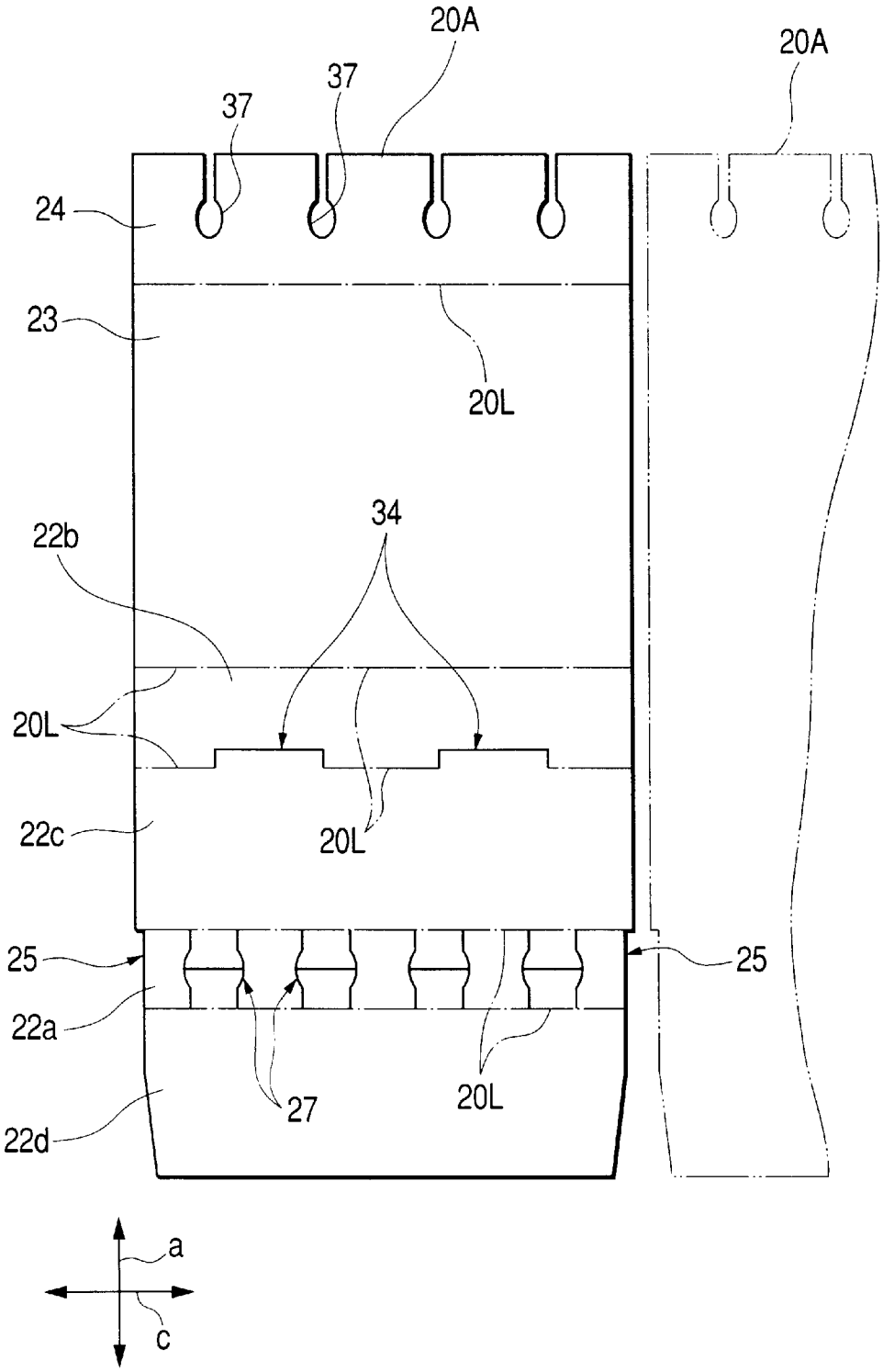
FIG. 3 is an expanded view of the inner box body.

As shown in FIG. 3, as to the inner box body 20, a plurality of cutting sheets 20A for inner boxes are also cut out from a sheet of raw material paper (for example, a cardboard), like the outer box body 10. Each of the cutting sheets 20A is provided with a upper side protection wall 22*a,* a lower side protection wall 22*b,* a front side protection wall 22*c,* a rear side protection wall 22*d,* a main body wall 23 and a slanted holding wall 24 (exemplarily shown as a terminal holding portion). These walls are suitably set to predetermined values in their shapes and sizes so as to hold the spark plugs 3 rigidly. The rear side protection wall 22*d* is used as an overlap-width with respect to the main body wall 23. A step portion 25 that is cut by two blades in the cutting process is formed at each of the upper side and rear side protection walls 22*a,* 22*d.* The step portion 25 serves to allow the displacement at the time of adhering the rear side protection wall 22*d* to the main body wall 23 thereby to improve the workability of fabricating the inner box body. Further, the cutting sheets 20A for inner boxes are cut out from a sheet of raw material paper in a manner that adjacent cutting sheets 20A are aligned in the elevational direction so as to be cut with the minimum amount of material.

Figure 4:
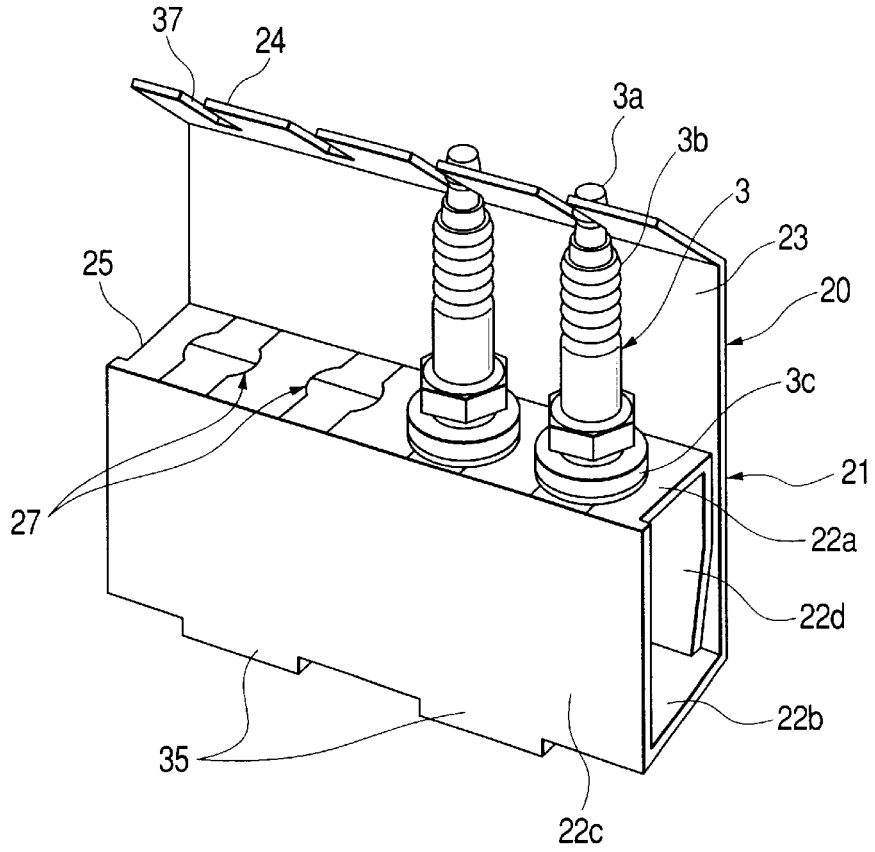
FIG. 4 is a perspective view of the inner box body.

In the cutting sheet 20A for the inner box, a plurality of folding lines 20L and cut line 27, 34 are formed in the cutting process. The inner box body 20 can be formed by bending the cut sheet along the folding line 20L, then pasting adhesive agent etc. on the rear side protection wall 22*d* and adhering the wall to the corresponding portion of the main body wall 23. As shown in FIGS. 4 and 6, the inner box body 20 includes a protection box portion 21 which is formed in a box shape by bending the upper and lower side, front and rear side protection walls 22*a* to 22*d.* The protection box portion 21 protects the screw portions 3*d* (exemplarily shown as engine engagement portions) and the outer side electrodes 3*e* of the spark plugs 3. The upper side protection wall 22*a* of the protection box portion 21 has a transversal width that is set to a length capable of holding the plurality of spark plugs 3. Further, the upper side protection wall 22*a* has a longitudinal width that is set to a length almost same as the diameter of the large diameter portion 3*c* of the metallic shell of the spark plug 3 (see FIG. 5).

Figure 5:
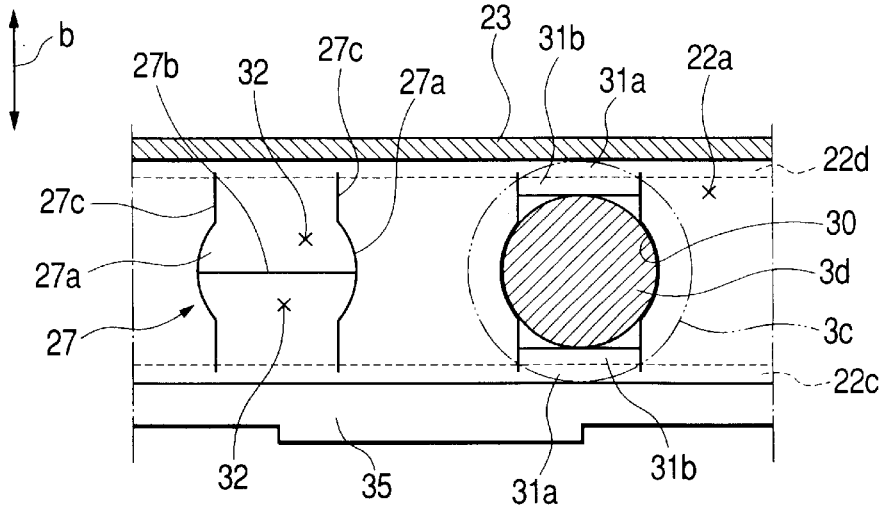
FIG. 5 is an enlarged plan view of the main portion of the inner box body.
Figure 6:
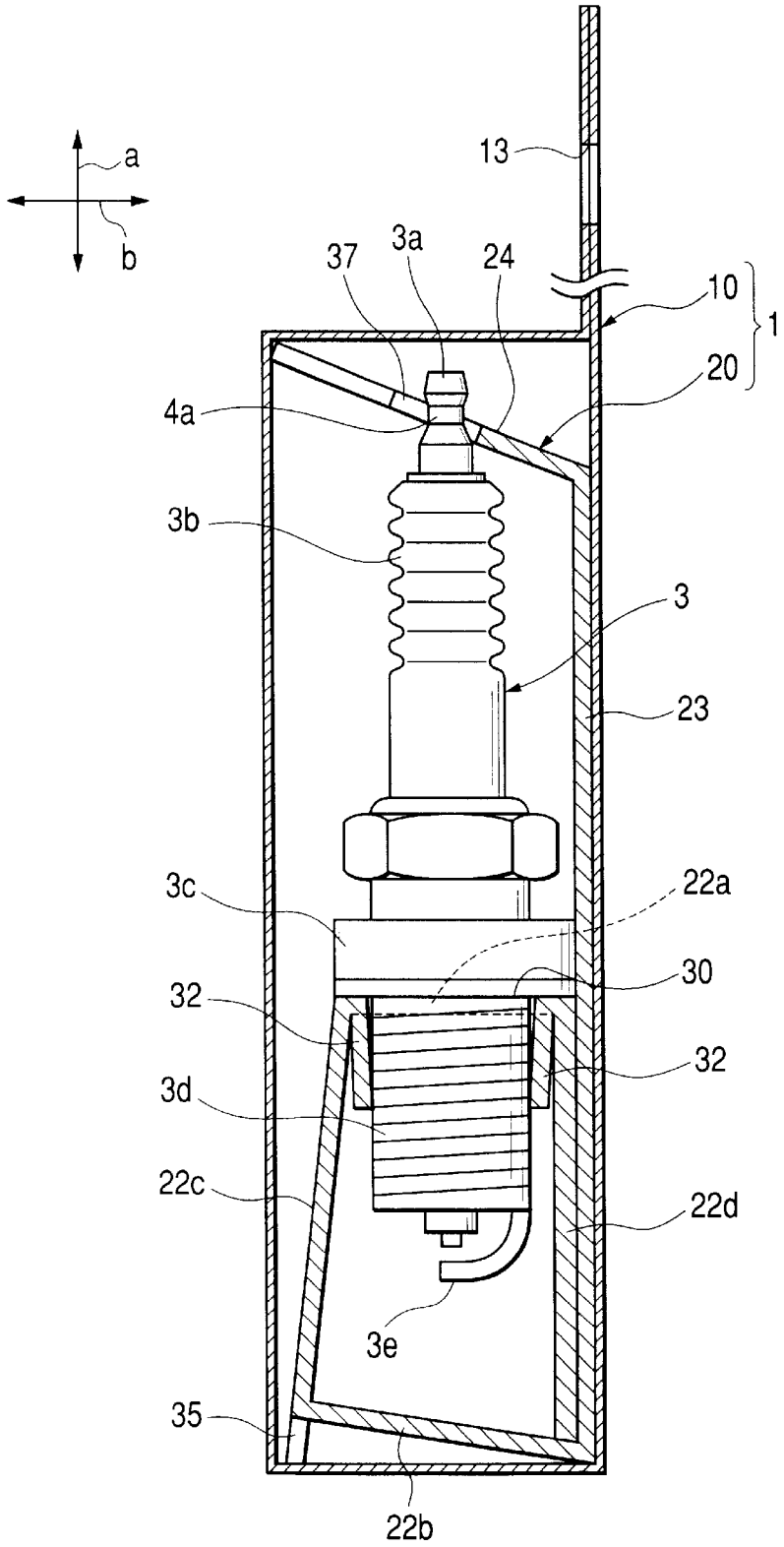
FIG. 6 is a longitudinal sectional view of a packaging box.

Further, as shown in FIG. 5, the upper side protection wall 22*a* is provided with cut lines 27. Each of the cut line is constituted by an arc cut line 27*a,* a split cut line 27*b* and an auxiliary cut line 27*c.* The arc cut line 27*a* is extended along the outer peripheries of screw portion insertion holes described later. The split cut line 27*b* divides the surface area corresponding to the screw portion insertion hole 30 in two areas along the longitudinal direction. The auxiliary cut line 27*c* extends from the arc cut line 27*a* toward the bent edge of the upper side protection wall. When the outer side electrode 3*e* and the screw portion 3*d* of the spark plug 3 are inserted with pressure into the cut line 27, the screw portion insertion hole 30 (exemplarily shown as an engine engagement portion insertion hole) capable of passing the screw portion 3*d* of the spark plug 3 therethrough is formed. Further, the upper side protection wall 22*a* is bent to the inside of the protection box portion 21 along the bent edge thereof thereby to form bent tabs 32 being contact with pressure to the screw portion 3*d* of the spark plug 3 (see FIG. 6). The lower surface of the large diameter portion 3*c* of the metallic shell of the spark plug 3 is placed on and supported by the surface areas that includes overlapped portions of the bent edges 31*a,* 31*b.* That is, the lower surface is placed on and supported by the surface areas including the bent edges 31*a* of the upper side protection wall 22*a* itself and the bent edges 31*b* of the bent tabs 32. Accordingly, sufficient strength of the packing box 1 is secured with respect to elevational falling thereof.

As shown in FIG. 6, the width of the lower side protection wall 22*b* along the longitudinal direction thereof is set to a value which is longer than the width of the upper side protection wall 22*a* along the longitudinal direction thereof and corresponds to the housing width of the outer box body 10 along the longitudinal direction thereof. Accordingly, the protection box portion 21 is entirely formed as an almost trapezoidal form. Thus, sufficient strength of the packing box 1 is secured with respect to longitudinal falling thereof. In this respect, the longitudinal widths of the lower side protection wall 22*b* of the inner box body 20 and the left and right side inner box protection walls 11*c,* 11*d* may be set in correspondence to the longitudinal width of the upper side protection wall 22*a* of the inner box body 20.

However, even if each of the spark plugs 3 is arranged in a small type or a large type, this embodiment is configured in the aforesaid manner so that only the inner box body 20 is changed in accordance with the selected one of the respective types and the outer box body 10 is used commonly for the both types. Note that the park plug of the small type means that the diameters of the screw portion 3*d* and the large diameter portion 3*c* of the metallic shell are relatively small, and a spark plug of the large type, the diameters of the respective portions are relatively large.

Further, cut lines 34 (shown in FIG. 3) are formed along the bent lines between the lower side protection wall 22*b* and the front side protection wall 22*c,* and a plurality of (for example, two) projection pieces 35 protruding downward are formed at the lower end of the front side protection wall 22*c* of the protection box portion 21. In a state that the inner box body 20 is housed within the outer box body 10, the projection pieces 35 and the rear side bend edge of the protection wall 22*b* abut against the housing bottom surface of the outer box body 10. Accordingly, a space is formed between the housing bottom surface and the lower side protection wall 22*b* and the lower side protection wall 22*b* is configured in a braced shape. In this manner, the strength of the packing box 1 is secured with respect to elevational falling thereof by forming the projection pieces 35, and the strength of the packing box 1 is secured with respect to longitudinal falling thereof by forming the lower side protection wall 22*b* in the braced shape.

As shown in FIGS. 3 and 6, a slanted holding wall 24 is provided with a plurality of (four) elliptical terminal portion insertion hole 37 are formed so as to insert therein and hold the narrow portions 4*a* of the terminal portions 3*a* protruding upward from the insulation members 3*b* of the spark plugs 3. Slits each having one end being opened are continuously formed at the terminal portion insertion hole 37. In a state that the inner box body 20 is housed within the outer box body 10, the free end of the slanted holding wall 24 is engaged in a braced shape against the housing corner portions of the outer box body 10. Thus, the strength of the packing box 1 is secured with respect to elevational and longitudinal falling thereof. The inner box body 20 is arranged in a manner that its paper fiber direction is set in the elevational direction, so that the strength of the packing box is secured with respect to elevational falling thereof.

(3) Assembling Function of the Packing Box

First, the outer box body 10 in a state being opened upward as shown in FIG. 1 is assembled as follows. The 10A for the outer box is bent along the folding line 10L, and then adhesive agent etc. is pasted on the flap walls 12*a* and the flap walls are adhered to the rear side inner box protection wall 11*f.* Then, the inner box body 20 is assembled as shown in FIG. 4 by bending the cutting sheet 20A for the inner box shown in FIG. 3 along the folding lines 20L, then pasting adhesive agent etc. on the rear side protection wall 22*d* and the rear side protection wall is adhered to the main body wall 23. Thereafter, when the outer side electrode 3*e* and the screw portion 3*d* of the spark plug 3 are inserted with pressure into the screw portion insertion hole 30 formed at the upper side protection wall 22*a,* the pair of the front and rear bent tabs 32 are bent inside of the protection box portion 21 by the cut line 27, and the pair of the bent tabs 32 are made in contact with pressure to the screw portion 3*d* of the spark plug 3 from the front and rear directions, respectively. When the spark plug 3 is further pushed, the lower surface of the large diameter portion 3*c* of the metallic shell of the spark plug 3 is placed on and supported by the upper surface of the upper side protection wall 22*a* of the protection box portion.

Next, when the respective spark plugs 3 are inserted in and held by all the screw portion insertion holes 30 by repeating the aforesaid operations, the slanted holding wall 24 disposed in an almost vertical posture is bent along the folding line 20L on this side, and the terminal portions 3*a* of the respective pugs 3 are inserted in and held by the terminal portion insertion hole 37 of the slanted holding wall 24 thereby to complete the inner box body 20. Then, as shown in FIG. 1, the inner box body 20 holding the plurality of the spark plugs 3 therein is inserted from the opening of the outer box body 10. In this case, adhesive agent and so on is pasted in advance on the housing surface of the rear side inner box protection wall 11*f* through the view window 14 of the outer box body 10. Then, the inner box body 20 is housed within the outer box body 10 in this state and the outer box body and the inner box body are adhered to each other. Thereafter, the bending flap walls 12*b,* the upper side inner box protection wall 11*a* and the main wall 11*g* are bent along the folding lines 10L to thereby house the inner box body 20 therein completely. Then, the main wall 11*g* and the rear side inner box protection wall 11*f* are overlapped to each other and both walls 11*g* and 11*f* are adhered by adhesive agent etc. Accordingly, the packing box 1 firmly holding the plurality of (four) spark plugs 3 shown in FIG. 7 is completed. The packing box 1 completed in this manner is displayed in a suspended state on a hook 16 of a sales display rack by using the suspending hole 13 in an automobile parts store etc. Although, in the aforesaid embodiment, the main wall 11*g* and the rear side inner box protection wall 11*f* are adhered to each other, instead thereof or in addition thereto, the upper side inner box protection wall 11*a* and the flap walls 12*b* may be adhered to each other.

(4) Effects of the First Embodiment

According to such a packing box 1 for the spark plugs, as shown in FIG. 5, the spark plugs 3 held within the inner box body 20 are disposed in a manner that the lower surfaces of the large diameter portions 3*c* of the metallic shells thereof are firmly placed on and supported by the surface area that includes the bent edges 31*a* of the lower side protection wall 22*b* and the bent edges 31*b* of the bent tabs 32. Thus, even when the packing box 1 is erroneously fallen, the protection box portion 21 of the inner box body 20 can be utmost prevented from being broken by the impact of its own weight of the spark plugs 3 upon falling in the elevational direction. Further, in the embodiment as shown in FIG. 6, the width of the lower side protection wall 22*b* in the longitudinal direction thereof is set to a value corresponding to the longitudinal housing size of the outer box body 10. Therefore, the outer and inner box bodies 10, 20 can be utmost prevented from being broken by the impact upon falling in the longitudinal direction even if the packing box 1 is erroneously fallen. Furthermore, in the embodiment, the projection pieces 35 and the rear side bent edges of the lower side protection wall 22*b* abut against the housing bottom surface of the outer box body 10. Accordingly, even if the packing box 1 is erroneously fallen, the outer and inner box bodies 10, 20 can be utmost prevented from being broken by the impact upon falling in the elevational direction. Moreover, in the embodiment, the free end of the slanted holding wall 24 engages in a braced shape with the housing corner portion of the outer box body 10. Accordingly, even if the packing box 1 is erroneously fallen, the outer and inner box bodies 10, 20 can be utmost prevented from being broken by the impact upon falling in the elevational and transversal direction. Further, since the terminal holding portion is formed by the single sheet-shaped slanted holding wall 24, the cost of the material can be suppressed and the workability of fabricating the box can be improved as compared with a terminal holding portion which is bent and formed in a box shape. Further, in the embodiment the slanted holding wall 24 holds the narrow portions 4*a* of the terminal portion 3*a* protruding upward form the insulation members 3*b* of the spark plugs 3. Accordingly, the spark plugs 3 can be held within the inner box body 20 more firmly as compared with a holding wall in which insulation members 3*b* having diameters lager than terminal portions 3*a* are inserted and held.thereby. Furthermore, in the embodiment the suspending holes 13 are formed at the main wall 11*g* and the rear side inner box protection wall 11*f* in the outer box body 10. Accordingly, the packing box is suspended and supported by means of these two suspending holes 13, the packing box 1 can be prevented from being broken even if a slight force is applied to the packing box in the suspended state.

The present invention is not limited to the aforesaid embodiment, and the embodiment of the invention may be modified in various types within the scope of the invention according to an object and a usage. That is, the overlapped portion between the main wall 11*g* and the rear side inner box protection wall 11*f* of the outer box body 10 may be fixed suitably by a fixing means. Alternatively, a solvent for vinyl chloride may be pasted on the rear surface of the outer box body 10, and the main wall 11*g* and the rear side inner box protection wall 11*f* may be subjected to the thermo-compression bonding upon assembling. When the packing box is configured in this manner, the packing box 1 capable of firmly housing and holding the inner box body 20 therein can be provided. Further, information representing efficiency etc. of the spark plugs 3 may be printed on the surface of the body 1. Further, an anti-theft tag may be inserted at the overlapped portion between the main wall 11*g* of the outer box body 10 and the rear side inner box protection wall 11*f*.

Furthermore, as shown in FIG. 7, a perforated line 7 for opening the packing box 1 may be formed at the front side inner box protection wall lie and the left and right inner box protection walls 11*c,* 11*d* of the outer box body 10 so that the spark plugs can be taken out easily. Although the explanation has been made as to an example where the perforated line 7 is formed along the frame of the view window 14 formed at the front side inner box protection wall lie, the perforated line 7 may be formed at the position away from the frame of the view window 14.

2. Second Embodiment

Figure 9:
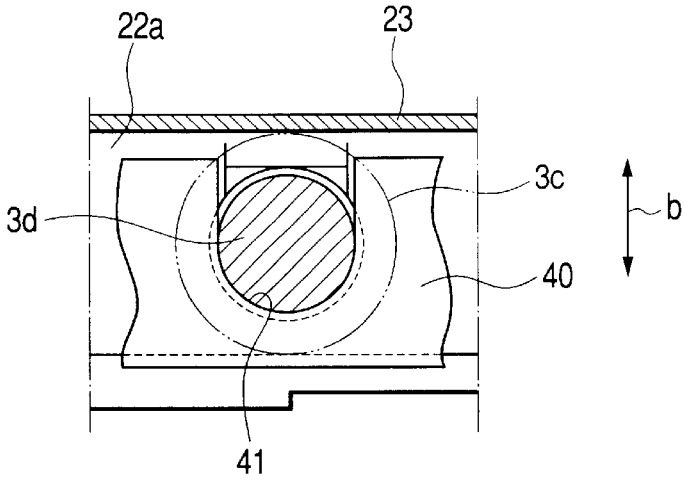
FIG. 9 is an enlarged plan view of the main portion of the inner box body in the second embodiment.
Figure 10:
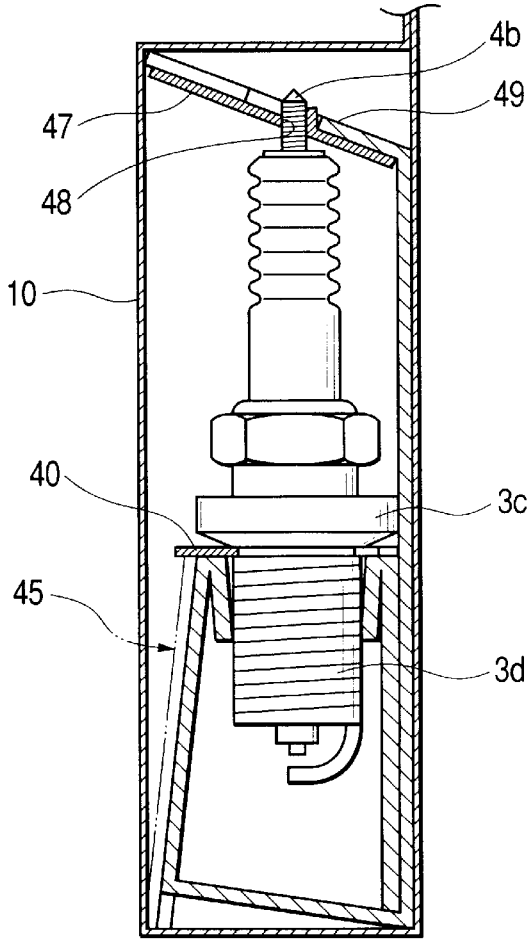
FIG. 10 is a longitudinal sectional view of the packaging box in the second embodiment.

Hereinafter, the second embodiment of the packaging box will be explained with reference to FIGS. 8 to 10. The second embodiment is characterized in the configuration of the inner box body suitable for different types of spark plugs 3 that differ in the shapes etc. from the spark plugs of the first embodiment. In these figures, like parts corresponding to those of the first embodiment are marked with the same references. First, the explanation will be made as to the type (so-called a conical sheet type) in which the lower surface of the large diameter portion 3*c* of the metallic shell of the spark plug 3 is configured to have a tapered surface. As shown by steady lines in FIGS. 8 and 10, a plate 40 is made of paper having the outer configuration almost same as the upper side protection wall 22*a* is used. The plate 40 prevents the large diameter portion 3*c* of the metallic shell from being buried in the screw portion insertion hole 30 of the inner box body 20. The plate 40 is provided with a plurality of insertion slits 41 each opened at one end and formed by cutting an arc area having a diameter (almost same as the diameter of the neck portion of the screw as shown in FIG. 9) smaller than that of the screw portion insertion hole 30. The number of the insertion slits corresponds to the number of the spark plugs 3 to be held (e.g., four). In a state that the screw portions 3*d* of the respective spark plugs 3 are inserted into all the screw portion insertion holes 30 of the protection box portion 21, the plate 40 is arranged to be sandwiched between the large diameter portions 3*c* of the metallic shells and the upper side protection wall 22*a*. Further, as shown in FIG. 9, the plate 40 is set to have such a size that the edges thereof on the slit opening side do not abut against the main body wall 23 in such a sandwiched state. Thus, even if there is a slight error in the size, such an error is absorbed, whereby the lower surfaces of the large diameter portions 3*c* of the metallic shells of the spark plugs 3 can be suitably placed on and supported by the reinforcement plate. Further, as shown in FIG. 10, the plate 40 protrudes from the upper side protection wall 22*a* so as not to abut against the outer box body 10 in the sandwiched state, whereby the plate 40 can be easily abutted against the spark plugs 3. The inner box body 20 is arranged in a manner that its paper fiber direction is set in the elevational direction like the first embodiment. Further, the plate is arranged in a manner that its paper fiber direction is set in the transversal direction so as to be orthogonal to the paper fiber direction of the inner box body 20, so that the strength of the packing box 1 is secured with respect falling thereof.

Next, the explanation will be made as to the type in which the inner box body 20 is formed by straw board or container board which is thinner than the cardboard in order to miniaturize the packing box 1. In this type, the inner box body 20 made of container board is not sufficient in the holding intensity of the spark plugs 3 and the intensity upon elevational falling. Thus, a reinforcement plate 45 is employed which is formed by a horizontal reinforcement plate 45*a* having almost same configuration as the aforesaid plate 40 and a vertical reinforcement plate 45*b* extending downward from the one side edge of the horizontal reinforcement plate 45*a*. In this manner, the inner box body 20 made of container board is set in its paper fiber direction in the elevational direction so as to secure the intensity of the front side protection wall 22*c*, and the reinforcement plate 45 is also set in its paper fiber direction in the elevational direction. Accordingly, the strength of the packing box 1 is secured with respect falling thereof.

Figure 8:
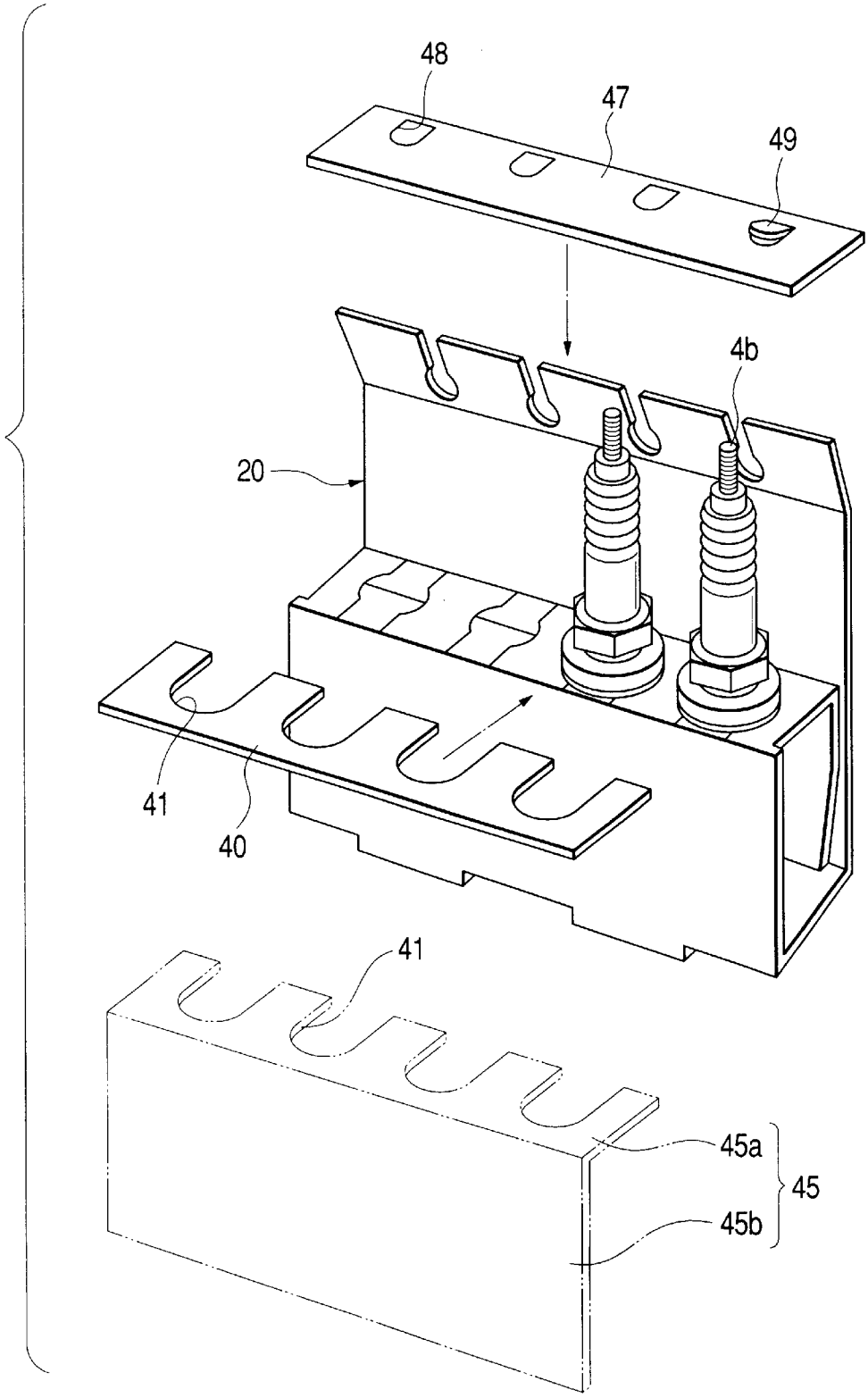
FIG. 8 is an explanatory diagram of a reinforcement plate in a second embodiment.

In a type where the terminal portion 3*a* of each of the spark plugs 3 forms a screw terminal 4*b*, a screw terminal holding plate 47 is inserted at the inside of the plate 24 as shown by a steady line in FIGS. 8 and 10 in order to more surely hold the screw terminals 4*b*. The screw terminal holding plate 47 is provided with a plurality of (e.g., four) screw terminal holding portions 48 and pressing tabs 49 for passing the screw terminals 4*b* of the spark plugs 3 therethrough and holding them. Since the screw terminal holding plate 47 is disposed at the inside of the plate 24, the workability of fabricating the inner box body can be improved as compared with the inner box body in which the screw terminal holding plate 47 is disposed at the outside.

3. Third Embodiment

Hereinafter, the third embodiment of the packaging box will be explained with reference to FIGS. 11 to 14. The third embodiment is characterized in the configuration of the inner box body suitable for a type in which the spark plugs 3 are placed horizontally. In these figures, like parts corresponding to those of the first embodiment are marked with the same references. As shown in FIG. 12, a plurality of cutting sheets 50A for inner boxes are cut out from a sheet of raw material paper (for example, a cardboard), like the first embodiment. Each of the cutting sheets 50A is provided with upper and lower side, left and right side, front and rear side protection walls 52*a*, 52*b*, 52*c*, 52*d*, a main body wall 53 and an auxiliary wall 54, a slanted wall 55 and a vertical wall 42. These walls are suitably set to predetermined values in their shapes and sizes so as to hold the two spark plugs 3 rigidly. Further, a flap wall 56 for protecting the spark plugs is provided so as to be continuous from the main body wall 53 and a folding flap wall 57 is provided so as to be continuous from the flap wall 56.

In the cutting sheet 50A for the inner box, a plurality of folding lines 50L and cut lines 27, 34, 39, 58 are formed in the cutting process. The inner box body 50 (shown in FIGS. 13 and 14) is assembled as follows. These walls are bent along the folding lines 50L, and adhesive agent is pasted on the rear side protection wall 52*d*. Then, the rear side protection wall is adhered to the corresponding portion of the main body wall 53. The free end edge of the vertical wall 42 is engaged with the a stop tab 53*a* formed at the main body wall 53 to thereby form a terminal holding portion 44 of an almost triangular pyramid shape by the main body wall 53, the auxiliary wall 54 and the slanted wall 55. Further, the wall 57 is folded within the box-shaped terminal holding portion 44 and overlapped with the auxiliary wall 54 to thereby serve to hold the shapes of the terminal holding portion 44 and the flap wall 56. The flap wall 56 covers the one side surface of the spark plug. Cut lines 58 are formed at the slanted wall 55. When the portion 3*b* of the spark plug 3 is pushed into the cut line 58, a terminal portion insertion hole 59 capable of inserting therein and holding the narrow portion 4*a* of the terminal portion 3*a* is formed. When the spark plug 3 is pushed further, a pressing tab 43 that is bent in the insertion direction and is brought in contact with pressure to the terminal portion 3*a* is formed. Such a inserting and holding function of the terminal portion 3*a* utilizing the pressing tab 43 is excellent in the workability of fabricating the box as compared with the first embodiment in which the spark plug is merely inserted in and held by the hole.

Figure 11:
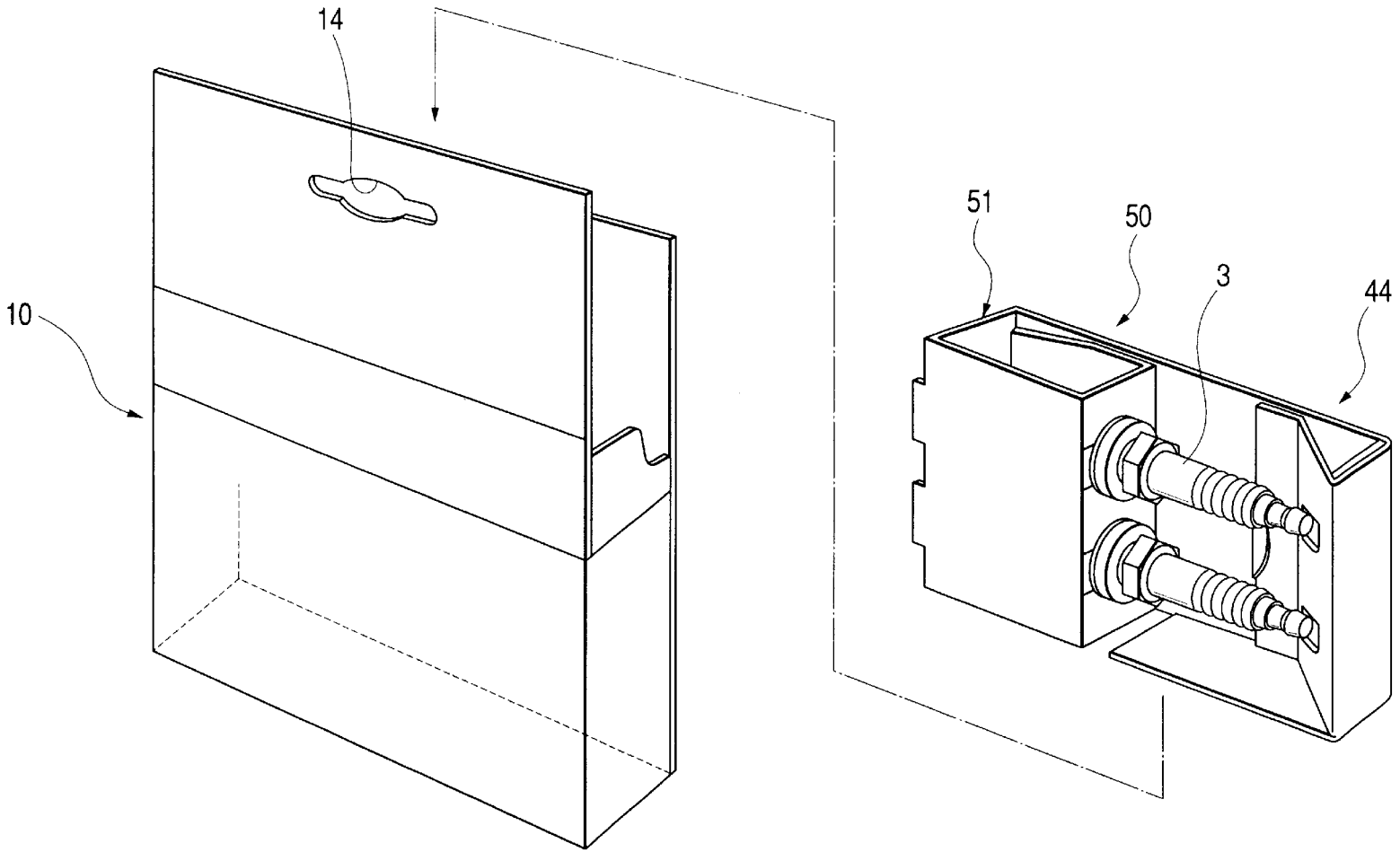
FIG. 11 is a perspective view for explaining the assembling of an inner box body with respect to an outer box body in a third embodiment.
Figure 12:
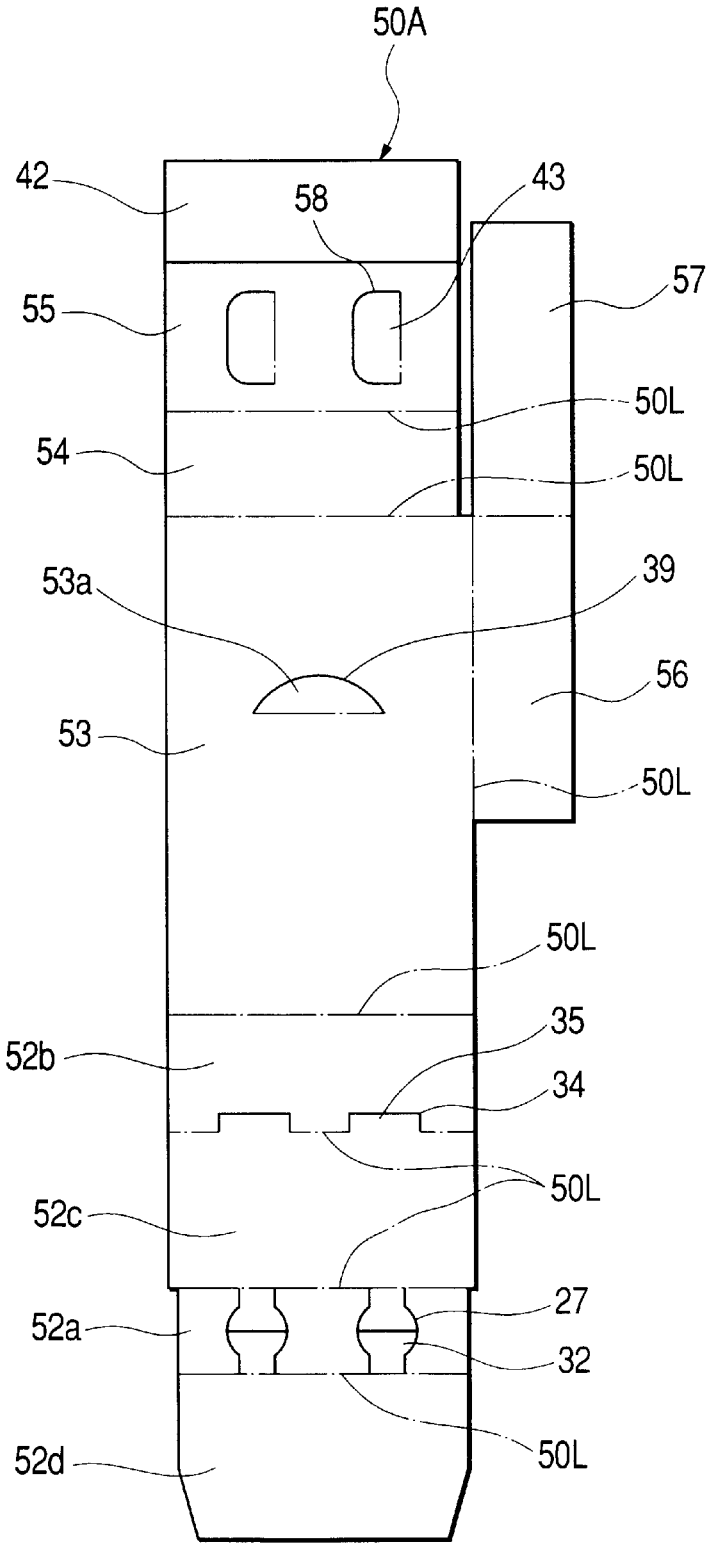
FIG. 12 is an expanded view of the inner box body in the third embodiment.
Figure 13:
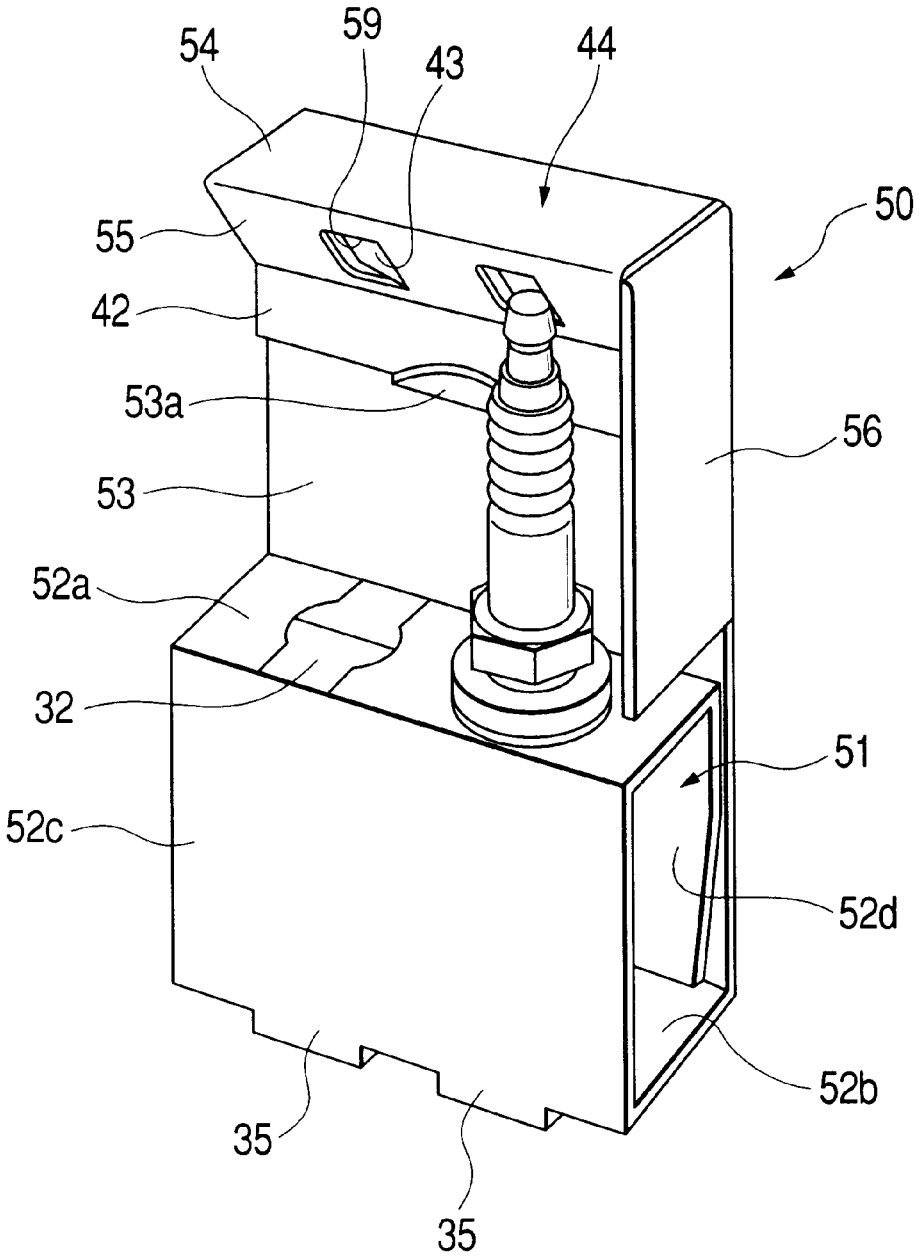
FIG. 13 is a perspective view of the inner box body in the third embodiment.
Figure 14:
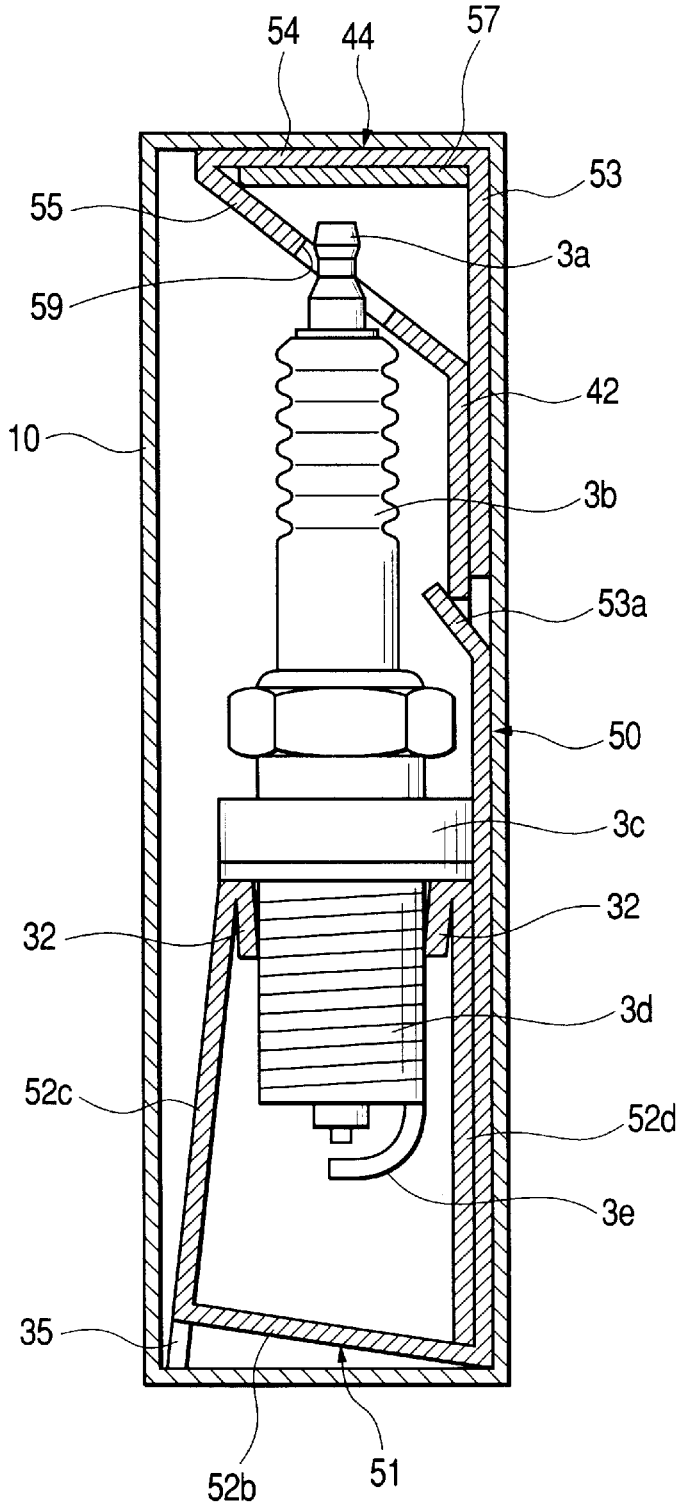
FIG. 14 is a longitudinal sectional view of the packaging box in the third embodiment.

As shown in FIG. 11, the inner box body 50 is housed within the outer box body 10 in a state that the flap wall 56 thereof is directed downward, that is, the spark plugs 3 are turned sideway. In this housing state, the flap wall 56 of the inner box body 50 is overlapped on the housing bottom surface of the outer box body 10. According to this configuration, even when the packing box 1 is erroneously fallen, the inner and outer box bodies 50, 10 can be utmost prevented from being broken by the impact upon falling in the elevational direction. In particular, this configuration is suitable for securing the intensity in the case where the hexagonal nut portion of the spark plug 3 has a relatively large diameter. Such a configuration of housing the inner box body 50 having the box-shaped terminal holding portion 44 in a turned sideway state is excellent in the insertion property as compared with the configuration like the first embodiment in which the inner box body 20 having the terminal holding portion as a free end is inserted in a turned sideway state.

4. Fourth Embodiment

Hereinafter, the fourth embodiment of the packaging box will be explained with reference to FIGS. 15 to 18. The fourth embodiment is characterized in the configuration of the inner box body 60 suitable for a type that is required to house many spark plugs 3 therein with a smaller volume. In these figures, like parts corresponding to those of the first embodiment are marked with the same references. As shown in FIG. 16, a cut sheet 60A for an inner box is provided with upper and lower side, front and rear side protection walls 62*a,* 62*b,* 62*c,* 62*d* and a main body vertical wall 63 which are suitably set to predetermined values in their shapes and sizes so as to hold the six spark plugs 3 rigidly. Further, a flap wall 64 for protecting the spark plugs is provided so as to be continuous from the upper side protection wall 62*a.* In the cut sheet 60A for the inner box, a plurality of folding lines 60L and cut lines 27, 34, 67 are formed in the cutting process. A protection box portion 61 (shown in FIGS. 17 and 18) is assembled in a manner that the walls are bent along the folding lines 60L, then adhesive agent is pasted on the rear side protection wall 62*d,* then the rear side protection wall is adhered to the corresponding portion of the main body vertical wall 63. The inner box body 60 is configured to include a pair of the protection box portions 61 thus assembled.

Figure 17:
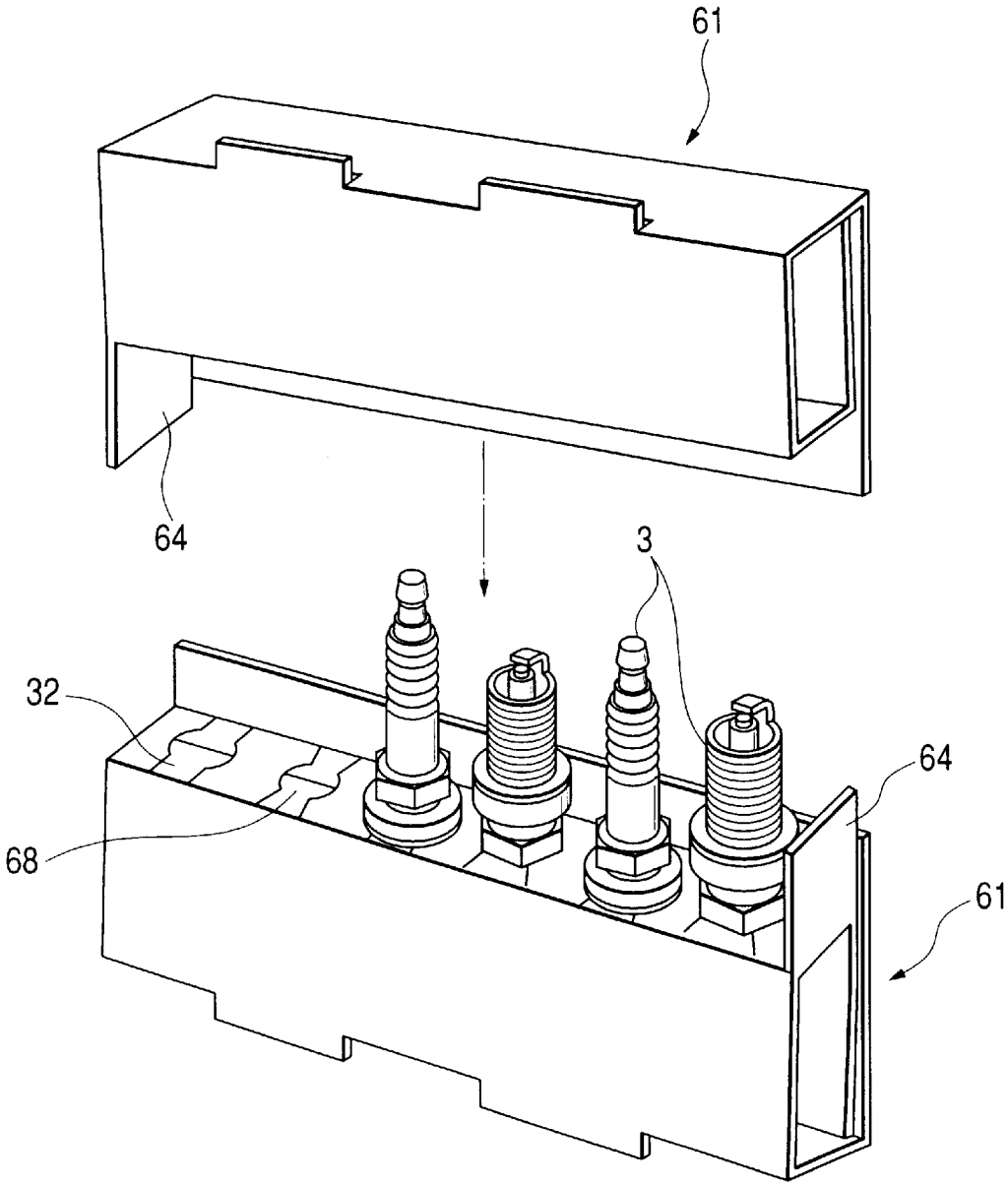
FIG. 17 is a perspective view of the inner box body in the fourth embodiment.
Figure 18:
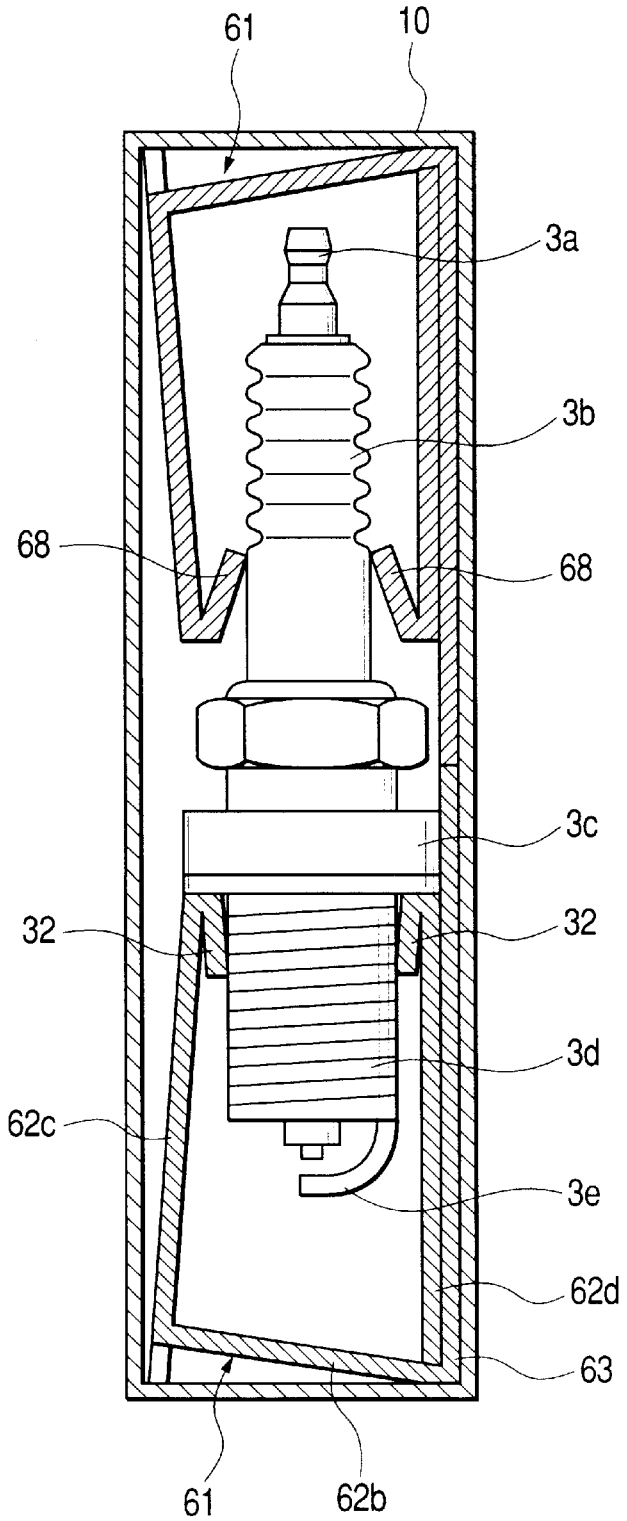
FIG. 18 is a longitudinal sectional view of the packaging box in the fourth embodiment.
Figure 19:
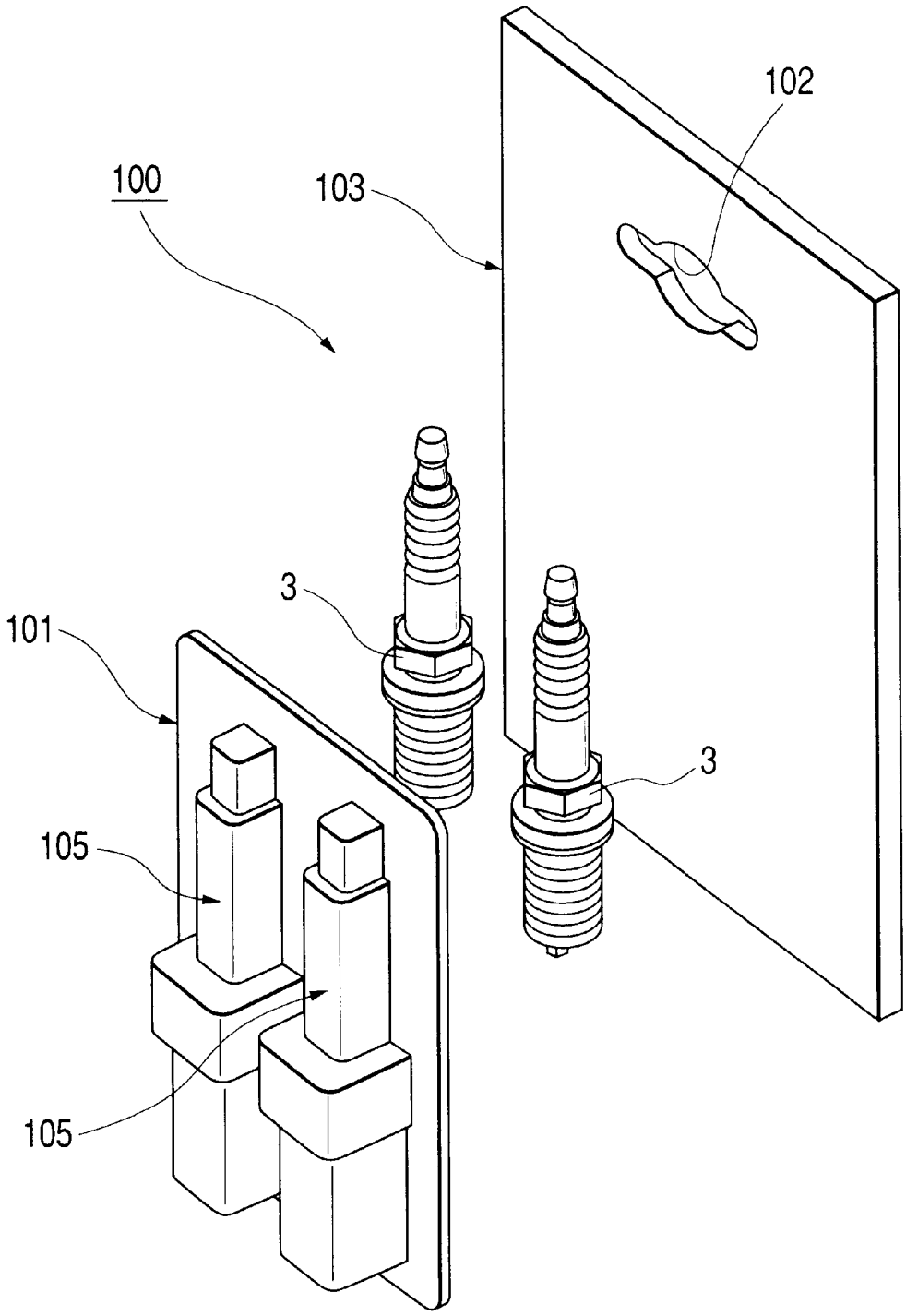
FIG. 19 (PRIOR ART)
FIG. 19 is a diagram for explaining a conventional spark plug packaging box.

A plurality of (e.g., three) screw portion insertion holes 30 are formed at the upper side protection wall 62*a* of each of the protection box portions 61, and a plurality of (e.g., three) insulation member insertion holes 66 are formed between the adjacent screw portion insertion holes 30. When the insulation members 3*b* of the spark plugs 3 are pushed and inserted into the cut lines 67, the insulation member insertion holes 66 are formed, respectively. Further, pressing tabs 68 which are bent in the insertion direction and made in contact with pressure to the insulation members 3*b* are formed. As shown in FIG. 17, in the single protection box portion 61, the screw portions 3*d* of the spark plugs 3 are inserted into the screw portion insertion holes 30 and the insulation members 3*b* of the spark plugs 3 are inserted into the insulation member insertion holes 66, respectively. Accordingly, the adjacent spark plugs 3 are placed and supported in opposite directions to each other along the longitudinal direction, respectively. Then, the other protection box portion 61 is covered from the upper direction on the protection box portion 61 which supports the spark plugs 3 in this manner. Therefore, the screw portions 3*d* and the insulation members 3*b* are inserted into the screw portion insertion holes 30 and the insulation member insertion holes 66 of the other protection box portion 61, respectively (as shown in FIG. 18). In this manner, the inner box body 60 that firmly holds the six spark plugs 3 is assembled.

Figure 15:
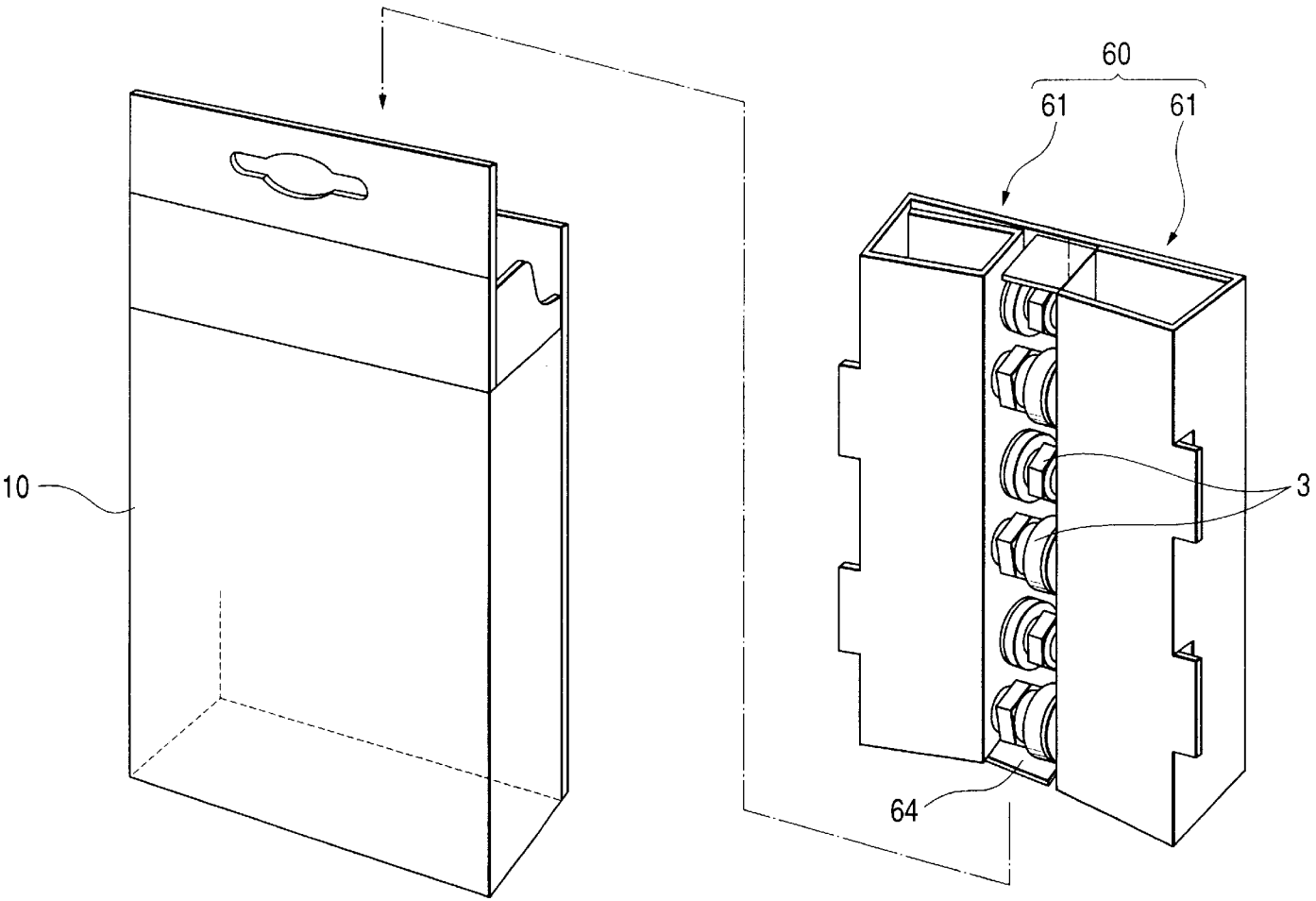
FIG. 15 is a perspective view for explaining the assembling of an inner box body with respect to an outer box body in a fourth embodiment.
Figure 16:
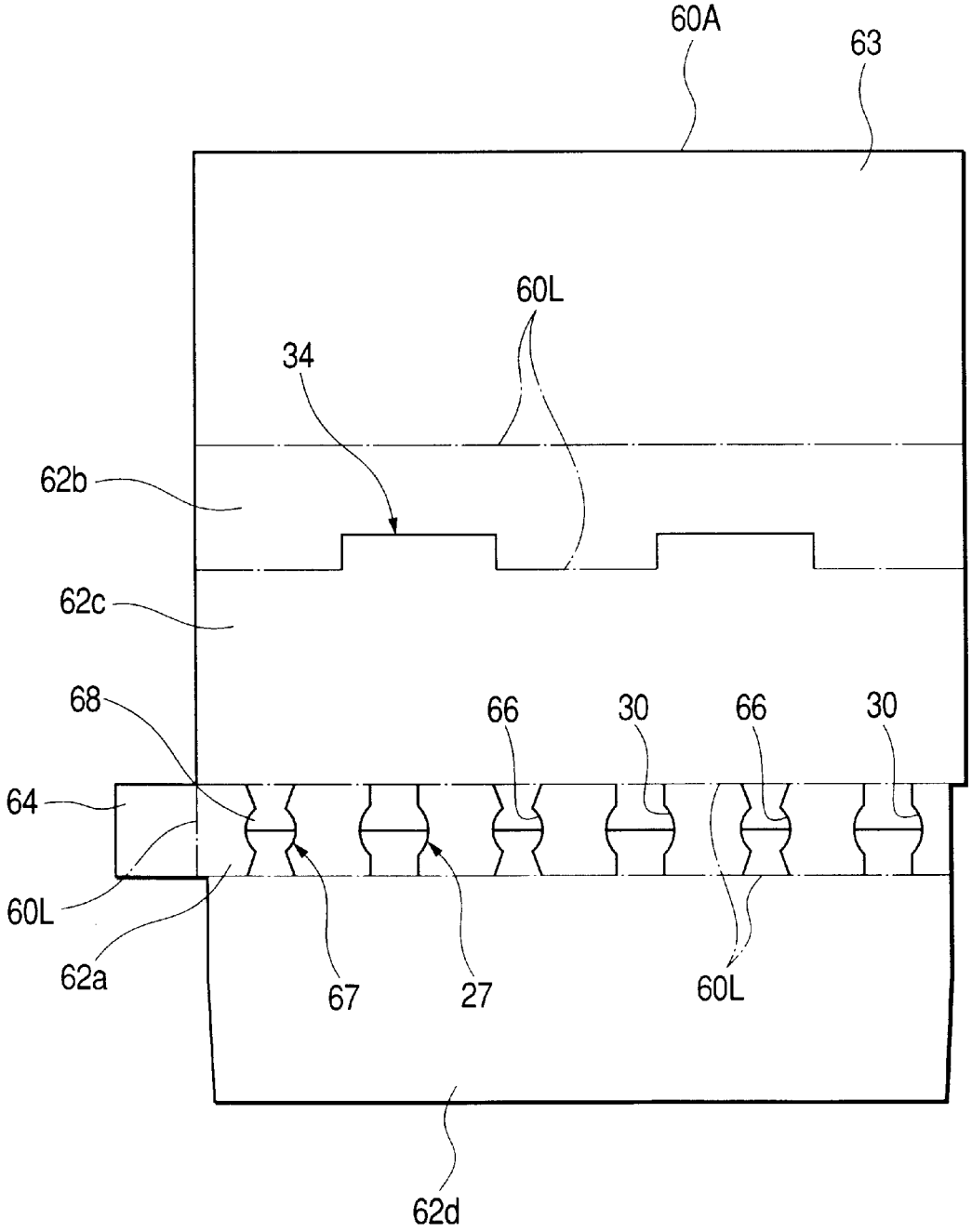
FIG. 16 is an expanded view of the inner box body in the fourth embodiment.

Then, as shown in FIG. 15, the inner box body 60 is housed within the outer box body 10 in a state that the flap wall 64 thereof is directed downward, that is, the spark plugs 3 are turned sideway. In this housing state, the flap wall 64 of the inner box body 60 is overlapped on the housing bottom surface of the outer box body 10. According to this configuration, even when the packing box 1 is erroneously fallen, the inner and outer box bodies 10, 60 can be utmost prevented from being broken by the impact upon falling in the elevational direction. Further, since the plurality of spark plugs 3 are supported in opposite directions to each other along the longitudinal direction, respectively, the phases of the large diameter portions 3*c* of the metallic shells of the spark plugs 3 can be overlapped in the transversal direction. Thus, the width of the inner box body 60 in the transversal direction can be made minimum and so the entire size of the packing box 1 can be designed compactly.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

According to the invention, the spark plugs can be held firmly within the inner box body, the packaging box and the spark plugs themselves can be prevented from being broken by the shock upon falling, and the invention can contribute to environmental protection.

According to the invention of claim 2, in addition to the effect of the invention claimed in claim 1, the spark plugs can be held further firmly within the inner box body.

According to the invention of claim 3, the intensity of the packaging box in the longitudinal direction can be improved.

According to the invention of claim 4, the intensity of the packaging box in the elevational direction can be improved.

According to the invention of claim 5, the spark plugs can be held firmly within the inner box body even if the spark plug is such a type that a tapered surface is formed at the metallic shell.

According to the invention of claim 6, the spark plugs can be held firmly within the inner box body even if the spark plug is such a type that the screw portion thereof has a relatively large diameter.

According to the invention of claim 7, various types of different spark plugs can be held further firmly within the inner box body.

According to the invention of claim 8, the spark plugs can be held further firmly within the inner box body.

According to the invention of claim 9, the intensity of the packaging box can be improved by the effects obtained by the braced shape.

According to the invention of claim 10, the workability of fabricating the packaging box can be improved in a type that the spark plugs are housed in a sideway manner within the packaging box.

According to the invention of claim 11, the spark plugs can be held further firmly within the inner box body.

According to the invention of claim 12, the spark plugs can be held firmly within the inner box body even if the spark plug is provided with the screw terminal.

According to the invention of claim 13, the packaging box can be designed compactly.

According to the invention of claim 14, the spark plugs can be protected surely in a type that the spark plugs are housed in a sideway manner within the packaging box.

According to the invention of claim 15, the packaging box can be suspended easily.

What is claimed is:

1. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelepiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part; and wherein said front and rear side protection walls have at least two bent edges that are formed by the bendable tabs, so that said bent edges are abutted against the lower surface of the large diameter portion of the metallic shell of the spark plug so as to support the spark plugs.

2. The packaging box according to claim 1, wherein a width of the bottom side protection wall in a front-rear direction of said inner box body is determined in accordance with a width of said inner box body housing space in a front-rear direction of said outer box body.

3. The packaging box according to claim 1, wherein said inner box body further comprises:

a main body wall extending upward from said protection box portion; and a terminal holding portion connected to said main body wall and having a terminal portion insertion hole that is capable of inserting therein and holding said terminal portion of said spark plug.

4. The packaging box according to claim 1, wherein said inner box body is provided with a flap wall which overlaps on a housing surface of said outer box body in a state that said inner box body is housed at said inner box body housing space within said outer box body.

5. The packaging box according to claim 1, wherein said inner box body housing space of said outer box body is constituted by:

upper side inner box protection wall;

lower side inner box protection wall;

right side inner box protection wall;

left side inner box protection wall;

front side inner box protection wall; and rear side inner box protection wall;

wherein said outer box body further comprises:

a main wall overlapping with the upper portion of said rear side inner box protection wall, and suspension holes aligned each other and formed on said main wall and the upper portion of said rear side inner box protection wall respectively in the overlapped state thereof.

6. The packaging box according to claim 1, further including:

a bent line between the front side protection wall and the bottom side protection wall, and a plurality of cut lines formed along said bent line.

7. The packaging box according to claim 1, wherein the rectangular parallelpiped shape of the inner box body housing space houses at least one of the protection box portion protection walls obliquely oriented with the outer box body.

8. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelepiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, and wherein said bendable tab is defined by a cut line that comprises:

an arc cut line formed along an outer periphery of said engine engagement portion insertion hole, a split cut line for dividing a surface area corresponding to said engine engagement portion insertion hole into two areas, and an auxiliary cut line extending from said arc cut line toward said bent edge of the top side protection wall.

9. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelepiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, and wherein one of said front side protection wall and said rear side protection wall has a projection piece which extended beyond a bending line relative to said bottom side protection wall and extended in flush with the one of said walls.

10. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelepiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, and a reinforcement plate made of paper and having an insertion slit formed by cutting an arc area having a diameter smaller than that of said engine engagement portion insertion part, wherein said reinforcement plate has a portion inserted between said large diameter portion of said spark plug and the top side protection wall of said protection box portion.

11. The packaging box according to claim 10, wherein said reinforcement plate comprises:

a horizontal reinforcement part in which said insertion slit is formed; and a vertical reinforcement plate extending downward from one side edge of said horizontal reinforcement plate.

12. The packaging box according to claim 10, wherein a paper fiber direction of said reinforcement plate intersects a paper fiber direction of said inner box body by a predetermined angle.

13. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelpiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, a main body wall extending upward from said protection box portion; and a terminal holding portion connected to said main body wall and having a terminal portion insertion hole that is capable of inserting therein and holding said terminal portion of said spark plug, wherein said terminal holding portion comprises:

a slanted holding wall extending in a slated upward direction from an upper end edge of said main body wall and having a free end edge that engages with a corner portion of said inner box body housing space of said outer box body in a state that said inner box body is housed in said outer box body, and wherein said main body wall is brought in surface-contact with a wall of said outer box body that defines a part of said inner box body housing space.

14. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelpiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, a main body wall extending upward from said protection box portion; and a terminal holding portion connected to said main body wall and having a terminal portion insertion hole that is capable of inserting therein and holding said terminal portion of said spark plug, wherein said terminal holding portion comprises:

an auxiliary wall extending in a direction normal to said main body wall from an end edge of said main body wall; and a slanted wall extending in a slanted downward direction from an edge of said auxiliary wall and having said terminal portion insertion hole, wherein said terminal holding portion is configured in a box shape that is defined by said main body wall, said auxiliary wall, and said slanted wall.

15. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelpiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, a main body wall extending upward from said protection box portion; and a terminal holding portion connected to said main body wall and having a terminal portion insertion hole that is capable of inserting therein and holding said terminal portion of said spark plug, wherein said terminal holding portion comprises:

a cut line extending along an outer periphery of said terminal portion insertion hole, and a pressing tab which is bent in insertion direction and made in contact with pressure to the terminal portion of said spark plug when said terminal portion of said spark plug is inserted into said terminal portion insertion hole.

16. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelpiped shape, wherein said top side protection wall has a bendable tab that is bent into an inner side of said protection box portion, said bendable tab in its bent state forms an engine engagement portion insertion part capable of inserting therein said engine engagement portion of said spark plug, wherein a bent edge of said bendable tab in its bent state supports a lower surface of said large diameter portion when said engine engagement portion of said spark plug is inserted into said engine engagement portion insertion part, a main body wall extending upward from said protection box portion;

a terminal holding portion connected to said main body wall and having a terminal portion insertion hole that is capable of inserting therein and holding said terminal portion of said spark plug, said terminal portion of said spark plug has a screw portion, and a screw terminal holding plate made of paper and having a terminal holding portion for holding said screw portion.

17. A packaging box for a spark plug, said spark plug including a center electrode, a terminal portion, a metallic shell having a large diameter portion at a center thereof and an engine engagement portion, an outer side electrode having one end coupled to said metallic shell, and an insulation member placed between said center electrode and said metallic shell for holding said center electrode at one end thereof and also holding said terminal portion at the other end thereof, said packaging box comprising:

an inner box body made of paper for holding said spark plug, said inner box body including a protection box portion that is configured by a front side protection wall, a rear side protection wall, a top side protection wall and a bottom side protection wall for protecting said outer side electrode and said engine engagement portion of said spark plug; and an outer box body made of paper and having an inner box body housing space that is formed into a rectangular parallelepiped shape, wherein said top side protection wall has a bendable tab that is bent into an inner side of said protection box portion, said bendable tab in its bent state forms an engine engagement portion insertion part capable of inserting therein said engine engagement portion of said spark plug, and the top side protection wall has an insulation member insertion part which is capable of inserting therein said insulation member of said spark plug and disposed in adjacent to said engine engagement portion insertion part, to thereby hold the adjacent two spark plugs so as to be directed opposite directions to each other;

wherein a bent edge of said bendable tab in its bent state supports a lower surface of said large diameter portion when said engine engagement portion of said spark plug is inserted into said engine engagement portion insertion part.

* * * * *